US007575252B2

(12) United States Patent
Smith

(10) Patent No.: US 7,575,252 B2
(45) Date of Patent: Aug. 18, 2009

(54) SYSTEMS AND METHODS FOR SUPPORTING SPORTING EQUIPMENT

(75) Inventor: David John Smith, Morristown, NJ (US)

(73) Assignee: MMSM Ideas, Inc., Morristown, NJ (US)

( * ) Notice: Subject to any disclaimer, the term of this patent is extended or adjusted under 35 U.S.C. 154(b) by 284 days.

(21) Appl. No.: 11/336,181

(22) Filed: Jan. 20, 2006

(65) Prior Publication Data

US 2007/0170698 A1 Jul. 26, 2007

(51) Int. Cl.
*A63C 11/00* (2006.01)

(52) U.S. Cl. ..... 280/809; 280/14.21; 36/122; 36/117.1

(58) Field of Classification Search ..... 280/14.21, 280/809; 36/117.1, 122, 54, 132, 72 R
See application file for complete search history.

(56) References Cited

U.S. PATENT DOCUMENTS 3,775,871 A * 12/1973 Serko ..... 36/118.8
4,940,255 A 7/1990 Donine
5,033,210 A * 7/1991 Dodge et al. ..... 36/118.8
5,564,729 A * 10/1996 Gomez et al. ..... 280/637
5,623,773 A * 4/1997 Bergamin ..... 36/117.1
5,653,467 A * 8/1997 Griffin et al. ..... 280/809
6,290,260 B1 * 9/2001 Brill ..... 280/809
6,321,470 B2 * 11/2001 Zazzi ..... 36/132
6,609,313 B2 * 8/2003 Orso ..... 36/117.3
7,073,813 B2 * 7/2006 Martin et al. ..... 280/613
2001/0001168 A1 * 5/2001 Zazzi ..... 36/132
2002/0000052 A1 * 1/2002 Orso ..... 36/117.3
2003/0011172 A1 1/2003 Compton
2004/0000529 A1 1/2004 Gladnick et al.
2004/0032122 A1 2/2004 Giannulli
2005/0016028 A1 * 1/2005 Safdeye ..... 36/132
2005/0280255 A1 * 12/2005 Kiernan ..... 280/809

* cited by examiner

*Primary Examiner*—Christopher P Ellis
*Assistant Examiner*—Jacob Meyer
(74) *Attorney, Agent, or Firm*—Rita C. Chipperson

(57) ABSTRACT

Systems and methods for efficiently and effectively supporting sporting equipment such as a snowboard. Also systems and methods for removably or permanently attaching an apparatus to a snowboard boot, sole, or a sub-component thereof such that the apparatus may be used to support the weight of sporting equipment such as a snowboard while a user of the sporting equipment is seated (e.g., while riding a chairlift). Systems and methods for fabricating an integral support within a boot, sole, or a sub-component thereof. These systems and methods include after-market items affixed to commercially-available boots, soles, or sub-components thereof by a snowboarder, snowboard professional, or the like, or, alternatively, such systems and methods may be incorporated by a boot or sole manufacturer during manufacture of the boot, sole, or a sub-component thereof. The systems and methods may be permanent or removable.

24 Claims, 15 Drawing Sheets

SYSTEMS AND METHODS FOR SUPPORTING SPORTING EQUIPMENT

BACKGROUND OF THE INVENTION

Embodiments of the present invention generally relate to systems and methods for efficiently and effectively supporting sporting equipment such as a snowboard. More specifically, the present invention relates to systems and methods for removably or permanently attaching an apparatus to a snowboard boot, sole, or a sub-component thereof such that the apparatus may be used to support the weight of sporting equipment such as a snowboard while a user of the sporting equipment is seated (e.g., while riding a chairlift).

Many systems and methods have been created to alleviate the strain to a skier's legs that may be caused by the weight of the skier's boots and skis while the skier is riding a chairlift. Many such systems and methods have been created to distribute the weight of boots and skis to other areas of the skier's body to reduce the strain on the skier's legs. In its most simplistic form, such systems include a support apparatus that is attached to a skier's body. In one such system, a belt is included that attaches to a skier's waist. A strap extends from the belt and includes a ski support at its opposite end. Equal parts of the support extend from both sides of the strap such that the skier may place one ski on each equal part thereby transferring the weight of the skis and boots to the skier's waist. The strap is adjustable to allow the amount of weight transferred to the waist to be adjusted and to accommodate skiers having differing leg lengths. The belt additionally includes a pouch for storing the support and strap while the apparatus is not in use.

In a similar support system, a belt is formed by crisscrossing two primary straps such that each strap is divided into one shorter portion and one longer portion. The ends of the shorter portions of the primary straps each include an attachment mechanism to allow the such ends to attach to each other such that a belt is formed. The shorter portions of the primary straps are located about the skier's waist such that the longer portions of the primary straps are located behind the skier's legs. Each end of the longer portions of each strap include boot attachment straps for attachment of the ends to the skier's boots, thereby transferring the weight of the boots and skis to the skier's waist.

Similarly, systems and methods have been created to equalize the load of a snowboard on a snowboarder while the snowboarder is riding a chairlift to alleviate the strain caused by unbinding one boot from the snowboard. In one form, such systems include a boot attachment. In one such system, a boot attachment is provided that allows the snowboarder to rest the snowboard atop the boot attachment. The boot attachment is secured to the boot via the boot laces and, when properly positioned, extends past the toe of the boot forming a shelf upon which the snowboard may be rested. Additionally, the boot attachment provides protection for the toe of the supporting boot by preventing the snowboard from physically contacting with the boot, thereby preventing damage such as scuffing to the supporting boot.

Another similar system includes an attachment for a snowboard that allows a snowboarder to insert the toe of his or her unbound boot into the attachment to equalize the load of the snowboard. In one such system, the snowboard attachment is a circular, non-locking clip that includes a base and a retainer. The base of the clip is attached to the snowboarder's snowboard in the desired position via an adhesive strip affixed to the downwardly facing surface of the clip. The retainer extends from the clip base such that it is cantilevered over the snowboard, thereby allowing the snowboarder to insert his or her boot into the clip to obtain support of the snowboard.

In yet another similar system, an attachment to a snowboard is provided that includes a base and two straps. The base of the attachment is secured to the snowboard in the snowboarder's desired position. Two straps extend from opposite ends of the base and each strap includes an attachment mechanism for attaching the straps to each other. To equalize the load of a snowboard, the snowboarder places his or her boot atop the base of the attachment and secures the boot to the snowboard by passing each strap over the toe of the boot and securing the straps to each other. Thereafter, the boot may be removed from the snowboard by detaching the straps from each other.

Yet another system includes a mechanism for equalizing the load of a snowboard as well as a mechanism for reducing the strain placed on the snowboarder's legs by the weight of the snowboard and boots. This system includes a belt with an attached body harness. A strap extends from the belt such that it may be located between the snowboarder's legs. The end of the strap opposite the belt is then attached to the snowboard and to the snowboarder's leg thereby transferring the weight from the snowboarder's legs to his or her waist and upper body. Additionally, the strap that extends from the belt may be adjusted such that the snowboarder can snowboard without detaching the system.

BRIEF SUMMARY OF THE INVENTION

Disclosed is an apparatus for supporting sporting equipment having at least one boot interface for interfacing the apparatus to a first boot and at least one support surface coupled to the boot interface, wherein a user of the supporting equipment wears the first boot and a second boot, wherein the sporting equipment is coupled to the second boot, and wherein coupling of the apparatus to the first boot along the boot interface positions the support surface such that the sports equipment may be easily rested atop the support surface when the user is seated naturally.

Finally, also disclosed is a supporting boot for supporting sporting equipment including at least one interior section into which a first foot is placed and at least one exterior section surrounding the interior section that includes at least one support surface, wherein a user of the supporting equipment wears the supporting boot on the first foot and wears a non-supporting boot on a second foot, wherein the sporting equipment is coupled to the non-supporting boot, and wherein the sports equipment may be easily rested atop the support surface when the user is seated naturally.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, embodiments that are presently preferred are shown in the drawings. It should be understood, however, that the invention is not limited to the precise arrangements and instrumentalities shown. In the drawings.

DETAILED DESCRIPTION OF THE INVENTION

Figure 1:
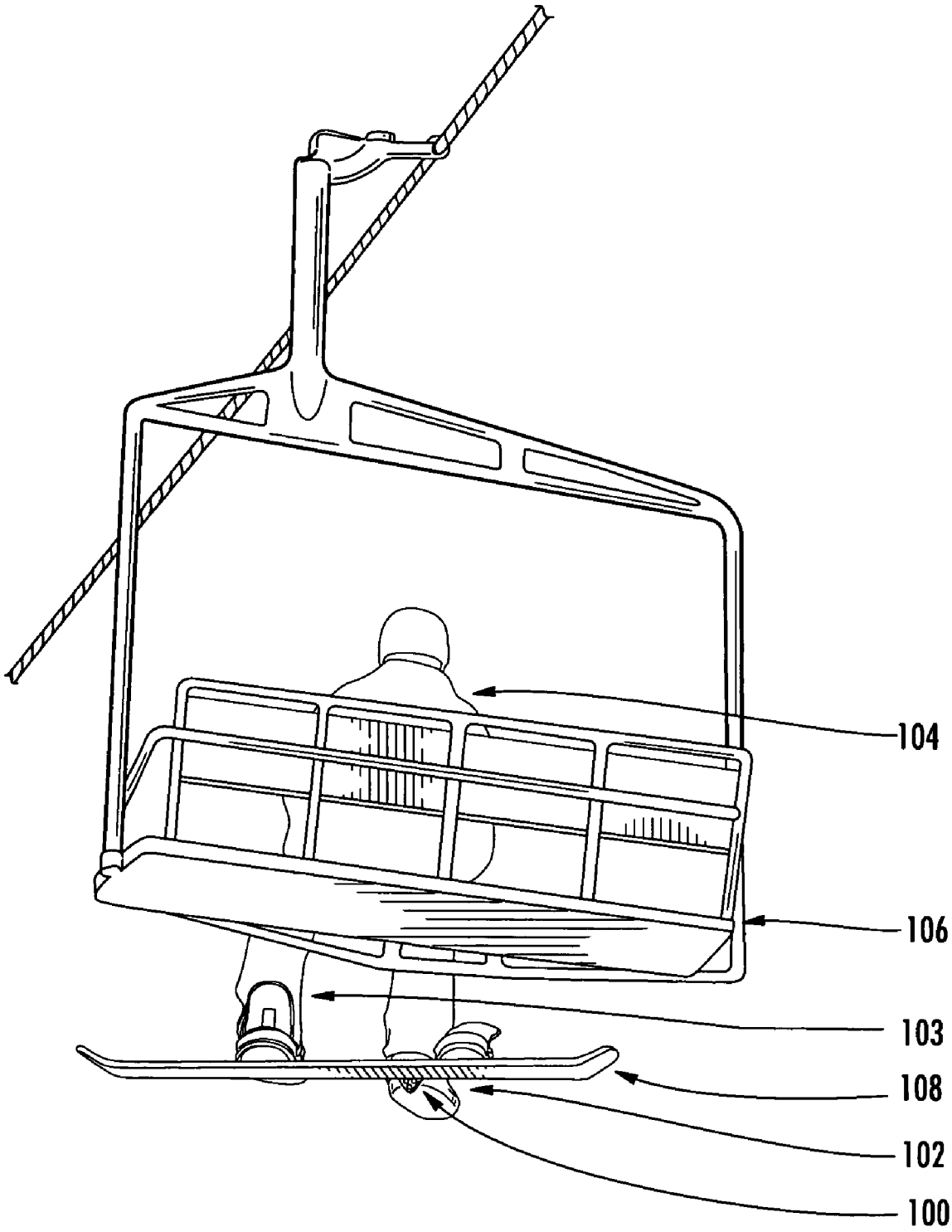
FIG. 1 depicts an apparatus for supporting a snowboard, wherein the apparatus is attached to one of the snowboarder's boots and it is supporting a snowboard while the snowboarder rides the chairlift in accordance with an embodiment of the present invention.

Referring first to FIG. 1, depicted is support apparatus 100 attached to unbound boot 102, which is donned by snowboarder 104, who is seated on chair 106 of a chairlift or the like. The method of attaching support apparatus 100 to unbound boot 102 is described in greater detail below with respect to FIGS. 5A-5B. Commonly, when a snowboarder prepares to board a chairlift, he or she detaches one of his or her two boots from the rearwardly facing end of snowboard 108 (i.e., the end of the snowboard located behind the snowboarder during snowboarding) to allow the leg fitted with unbound boot 102 to provide support and guidance when snowboarder 104 is not snowboarding (e.g., while waiting in line for the chairlift, while riding the chairlift, while departing the chairlift, etc.). Typically, it is easiest to navigate a snowboard by allowing the boot such as boot 103 attached to the forward facing end of a snowboard (i.e., the end of the snowboard located ahead of the snowboarder during snowboarding) to remain attached or bound to the snowboard and detaching or unbinding the boot attached to the rearwardly facing end of the snowboard therefrom. Consequently, a regular-footed snowboarder (i.e., a person who snowboards with the left foot attached to the forward facing end of a snowboard and the right foot attached to the rearwardly facing end of the snowboard) will detach his or her right boot, whereas a goofy-footed snowboarder (i.e., a person who snowboards with the right foot attached to the forward facing end of a snowboard and the left foot attached to the rearwardly facing end of the snowboard) will detach his or her left boot.

Figure 2:
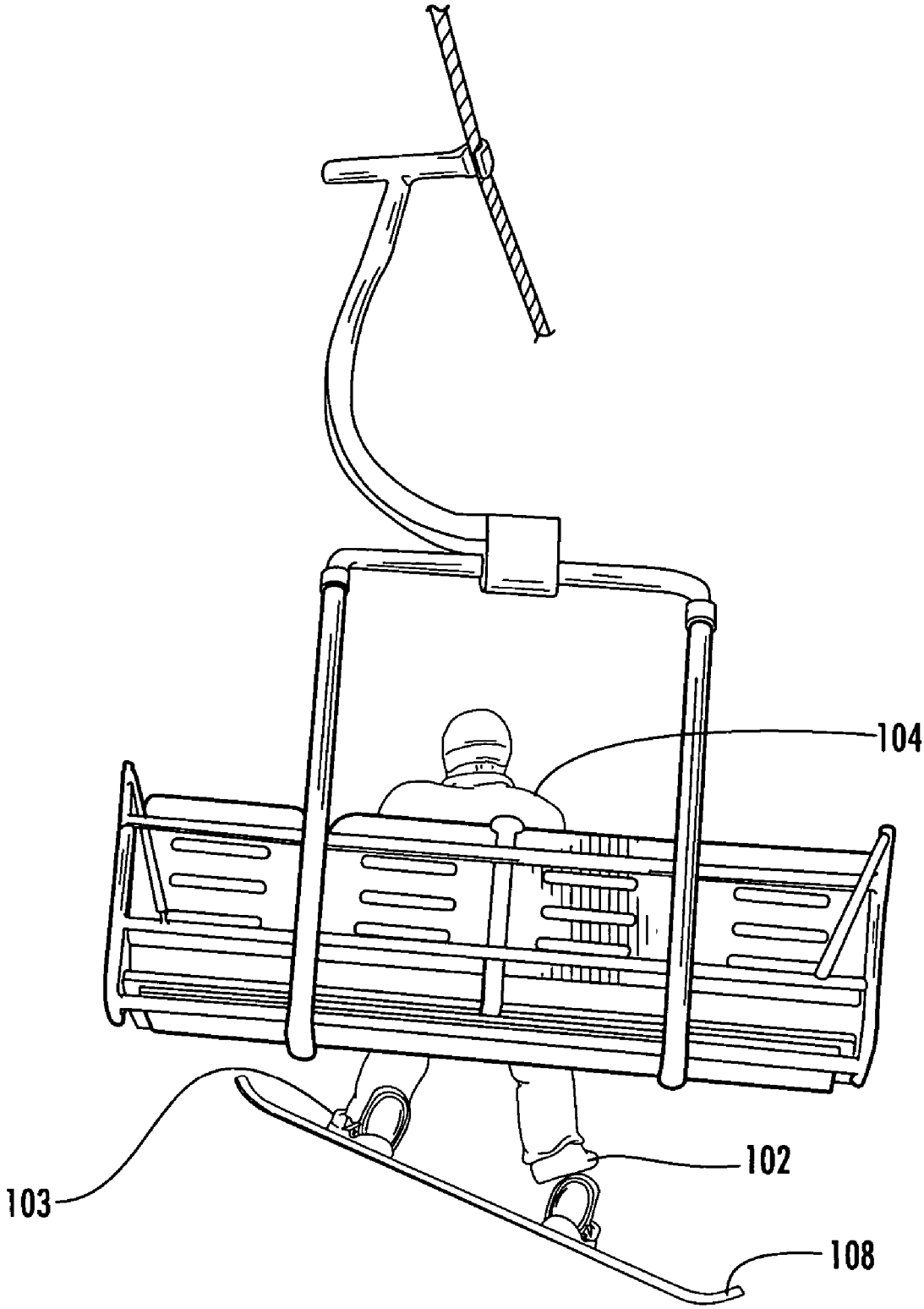
FIG. 2 (PRIOR ART)
FIG. 2 depicts a rear view of a snowboarder riding a chairlift in accordance with the prior art.

Referring next to FIG. 2, depicted is a rear view of a snowboarder riding a chairlift in accordance with the prior art. When an apparatus such as support apparatus 100 is not used, detachment of a boot (i.e., unbound boot 102) from snowboard 108 causes snowboarder 104 to support snowboard 108 entirely with the leg fitted with bound boot 103, which may be burdensome in instances such as riding the chairlift. Supporting snowboard 108 with only one leg often causes excessive strain on the supporting leg and knee causing fatigue and/or soreness. Such fatigue and soreness may lead to any one or more of a variety of problems including reduction of the length of time for which snowboarder 104 may snowboard, increased likelihood of an injury during snowboarding, and a general reduction in the overall enjoyment of the sport.

To alleviate the aforementioned problems, many snowboarders have attempted to support the heel edge of snowboard 108 (i.e., the edge of the side of the snowboard located behind the heel of bound boot 103) atop the toe of unbound boot 102. However, since unbound boot 102 is typically aligned with bound boot 103 when snowboarder 104 is seated naturally as depicted in FIG. 2, resting the heel edge of snowboard 108 atop the toe of unbound boot 102 would require snowboarder 104 to rotate his or her leg (i.e., the leg supporting snowboard 108) counterclockwise while extending it forward such that it clears the leg fitted with unbound boot 102. Such rotation of the supporting leg, if possible, tends to be extremely difficult and uncomfortable and subjects snowboarder 104 to an increased risk of joint injuries. Such positioning of snowboard 108 is increasingly difficult when one or more snowboarders, skiers, or the like are seated adjacent to snowboarder 104, as snowboarder 104 must be careful that he or she does not injure the adjacent snowboarders, skiers, or the like. Furthermore, attempting such a contorted position increases the likelihood of an improper movement that may cause snowboarder 104 to fall from the chair of a chairlift, thereby risking serious injury or death.

Figure 3A:
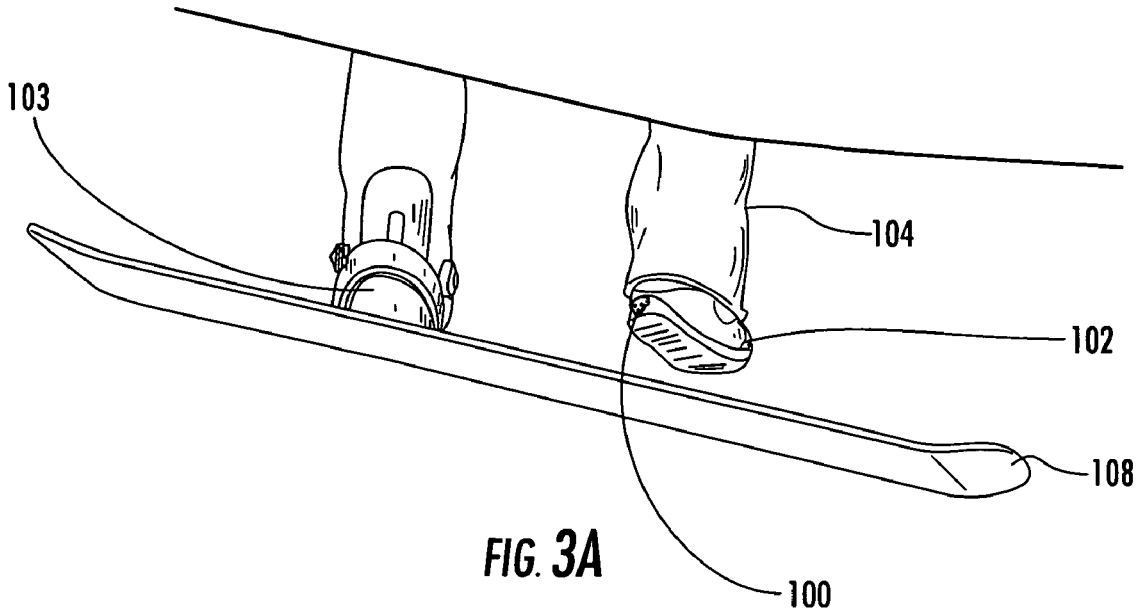
FIG. 3A depicts a rear view of a snowboarder riding a chairlift prior to the snowboarder resting his or her snowboard atop an apparatus for supporting a snowboard in accordance with the present invention.
Figure 3B:
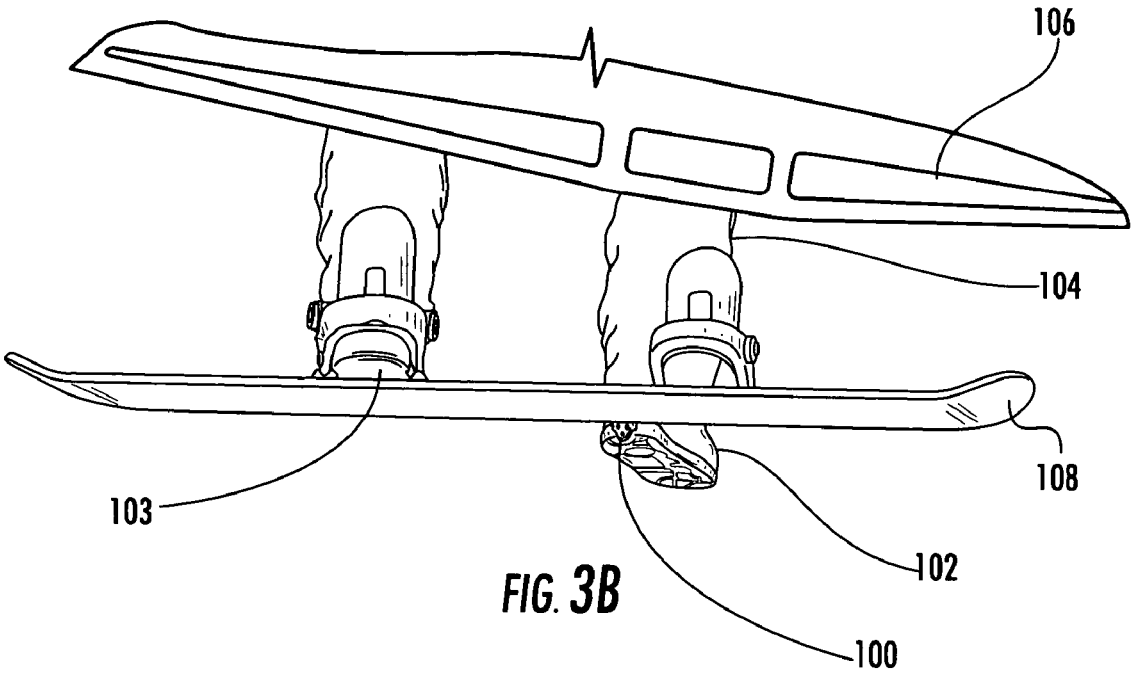
FIG. 3B depicts a rear view of a snowboarder riding a chairlift subsequent to the snowboarder resting his or her snowboard atop an apparatus for supporting a snowboard in accordance with the present invention.

Referring now to FIGS. 3A and 3B, use of a support apparatus such as support apparatus 100 allows a snowboarder such as snowboarder 104 to equalize the load of a snowboard such as snowboard 108 between both of the snowboarder's legs, thereby preventing the excessive strain and/or soreness caused by supporting snowboard 108 with one leg. As depicted in FIG. 3A, after boarding a chair of a chairlift, unbound boot 102 is naturally aligned with bound boot 103 and is therefore orientated directly above snowboard 108. By attaching support apparatus 100 to the heel or other rearward portion of unbound boot 102 as described in greater detail below with respect to FIGS. 5A-5B, snowboarder 104 may quickly and easily rest the toe edge of snowboard 108 (i.e., the edge of the side of the snowboard located in front of the toe of bound boot 103) upon support apparatus 100 with minimal motion and effort and without the need to clear the leg fitted with unbound boot 102 as depicted in FIG. 3B. Consequently, such strategic placement of support apparatus 100 allows snowboarder 104 to sit in a natural, comfortable position and to support snowboard 108 with both legs, while minimizing the motion required by snowboarder 104 to achieve this position. Such minimization lessens the potential for injury or death to snowboarder 104 and snowboarders, skiers, or the like seated adjacent to snowboarder 104 in chair 106 that may be caused by actions such as improper joint rotation, falling from chair 106, and the like.

In one aspect of the present invention such as that depicted in FIGS. 3A-3B, support apparatus 100 is non-locking. That is, snowboard 108 rests atop support apparatus 100 without being secured thereto. This non-locking aspect of some embodiments of support apparatus 100 facilitates activities such as disembarking from chair 106 by eliminating the need to unlock snowboard 108 from support apparatus 100 prior to disembarkation. The non-locking nature of support apparatus 100 minimizes the risk of injury to snowboarder 104 due to actions such as forgetting to detach snowboard 108 from support apparatus 100, misjudging the time required to detach snowboard 108 from support apparatus 100 (causing them to fall or to be unable to disembark from chair 106), and the like. However, locking embodiments of support apparatus 100 may be substituted without departing from the scope of the present invention.

Furthermore, although FIGS. 3A and 3B depict attachment of support apparatus 100 to the snowboarder's right boot, support apparatus 100 may be alternatively attached to the snowboarder's left boot. For example, a regular-footed snowboarder may be inclined to attach support apparatus 100 to his or her right boot since the right boot is typically unbound from snowboard 108 for walking, riding a chairlift, and the like. However, a goofy-footed snowboarder may be inclined to attach support apparatus 100 to the left boot since he or she may be more inclined to unbind the left boot from snowboard 108 for walking, riding a chairlift, and the like. Support apparatus 100 may be attached to either of the snowboarder's right or left boots, or both boots, without departing from the scope of the present invention.

Attachment of support apparatus 100 to both boots (i.e., both the left and right boot) may be convenient in cases including, but not limited to, rental boots (i.e., both regular and goofy-footed snowboarders may rent the boots), support apparatus installed integral to the boots (i.e., the boot manufacturer does not know in advance of the sale of the boot whether the buyer is a regular or goofy-footed snowboarder), and snowboarders who alter snowboarding styles (i.e., snowboarders who switch between regular and goofy-footed snowboarding).

Figure 4A:
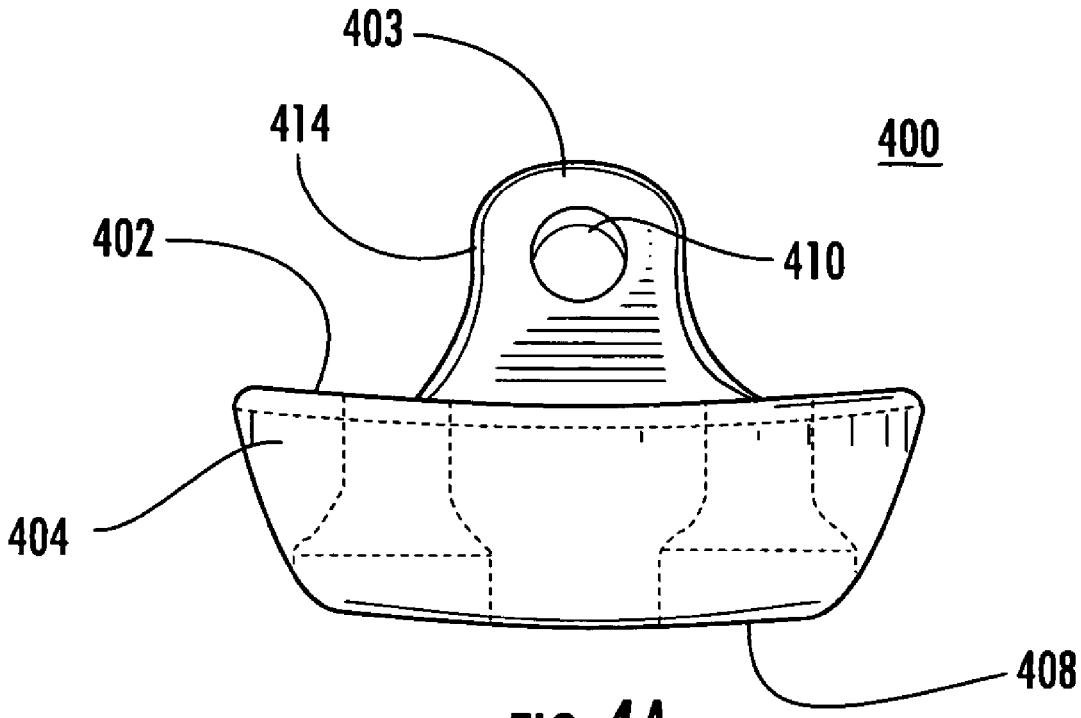
FIG. 4A depicts a top view of a support apparatus in accordance with one embodiment of the present invention as depicted in FIGS. 4A-4D.

Referring now to FIG. 4A, depicted is a top view of one embodiment of support apparatus 400 prior to attachment to a boot in accordance with the present invention. Support apparatus 400 may be fabricated any one of, or a hybrid of, a variety of durable materials such as urethanes, polyurethanes, polymers, rubbers, plastics, fiberglass reinforced plastics ("FRP"), and the like. Preferably, such materials minimize damage to and/or dulling of the downwardly facing surface of a snowboard and are capable of withstanding cold temperatures, extreme temperature changes, and moisture. Furthermore, use of a pliable material allows support apparatus 400 to conform and/or seal to the external shape and/or surface of a boot, thereby minimizing gaps, pockets, and the like between support apparatus 400 and the boot, which may increase the likelihood of unintentional separation of support apparatus 400 from the boot. Such conformance or sealing also allows support apparatus 400 to accommodate imperfections in the external shape and/or surface of the boot, which provides a more solid installation of support apparatus 400 to the boot. However, non-pliable materials may be used without departing from the scope of the present invention.

In one embodiment of the present invention, support apparatus is manufactured from a polyurethane. Such material operates well in low temperatures, is lightweight, pliable, and impact resistant, has superior corrosion resistance, dimensional stability, rigidity, and load capability, and is capable of molding to fit the external shape and/or surface of a variety of boot designs. Also, use of a moldable material such as polyurethane allows support apparatus 400 to be manufactured via a simple, less expensive, streamlined, one step process such as thermoplastic or thermoset injection molding which may greatly reduce the time and cost required to fabricate support apparatus 400. However, alternate materials including those having varying rigidities may be substituted for support apparatus 400 without departing from the scope hereof. Also, in lieu of thermoplastic or thermoset injection molding, alternate inexpensive methods of manufacturing for support apparatus 400 may be substituted including, but not limited to, resin transfer molding, blow molding, rotational molding, thermoforming, structural foam molding, or compression molding.

Figure 4B:
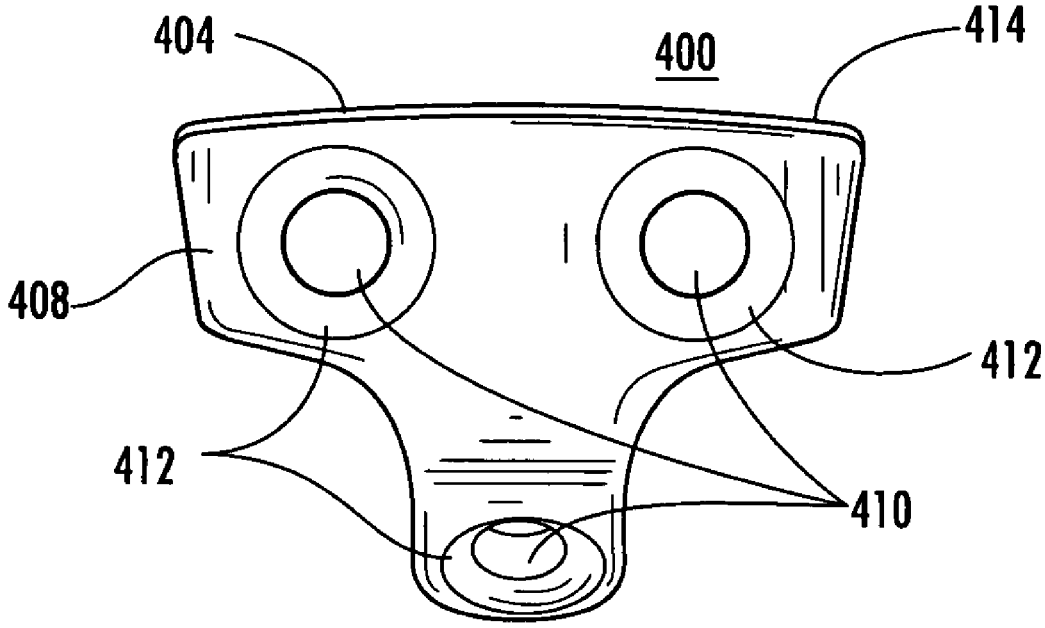
FIG. 4B depicts a rear view of a support apparatus in accordance with the embodiment of the present invention depicted in FIGS. 4A-4D.
Figure 4C:
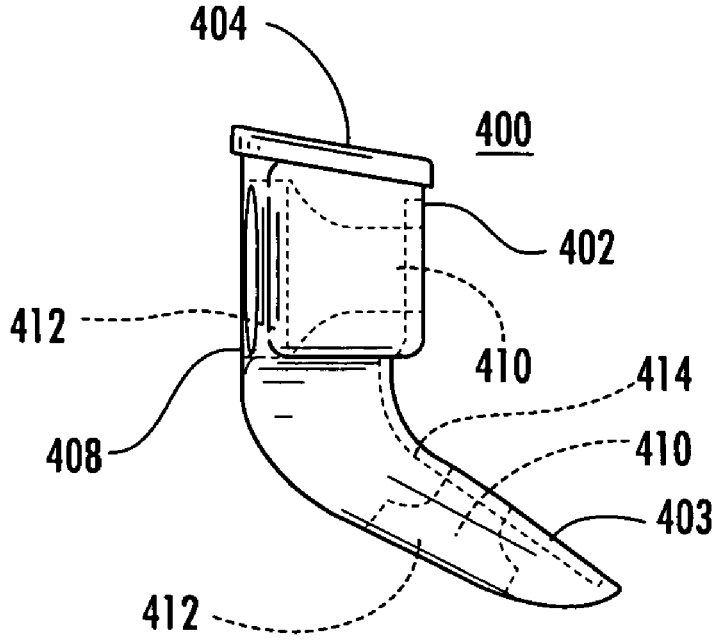
FIG. 4C depicts a side view of a support apparatus in accordance with the embodiment of the present invention depicted in FIGS. 4A-4D.

The embodiment of the support apparatus 400 depicted in FIGS. 4A-4C includes, inter alia, upper boot interface 402, lower boot interface 403, and support surface 404. After attachment of support apparatus 400 to a boot, upper and lower boot interfaces 402 and 403, respectively, become a common boundary between support apparatus 400 and the boot. Consequently, in some embodiments of the present invention, upper and lower boot interfaces 402 and 403, respectively, are manufactured or otherwise formed to conform (e.g., via a moldable material) to the external surface of a variety of boots known in the art. Furthermore, in some embodiments of the present invention, support apparatus 400 is made to be model-specific (i.e., upper and/or lower boot interfaces 402 and 403, respectively, are designed to interface with a specific manufacture and/or model of boot). One such form for upper and lower boot interfaces 402 and 403, respectively, are depicted in the views shown in FIGS. 4A, 4C, and 4D. However, other forms, shapes, and/or configurations for upper and lower boot interfaces 402 and 403, respectively, may be substituted without departing from the scope of the present invention. Or, alternatively, boot interface may comprise a single section such as the boot interfaces depicted in FIGS. 6A-6D, as discussed in greater detail below.

In the embodiment of the present invention depicted in FIGS. 4A-4D, support surface 404 is about perpendicular to upper boot interface 402 such that when support apparatus 400 is installed on a boot, as discussed in greater detail below with respect to FIGS. 5A and 5B, support surface 404 is about horizontal and about perpendicular to the heel of the boot. Support apparatus 400 is installed on the boot such that it does not interfere with typical, commercially available boot bindings. Such configuration of support surface 404 facilitates placement of the toe edge of a snowboard atop support apparatus 400 while riding a chairlift since, when the snowboarder is seated naturally, support surface 404 is located in approximately the same position as the toe edge of a snowboard. Therefore, placement of a snowboard atop support surface 404 requires only a slight rotation and/or elevation of the bound boot such as bound boot 102.

In one embodiment of the present invention such as that depicted in FIGS. 4A-4D, support surface 404 is angled slightly upward toward its distal end to minimize the possibility of the toe edge of the snowboard sliding off support surface 404. However, alternate embodiments of the present invention are envisioned in which support surface may be otherwise angled or otherwise inclined to facilitate resting of a snowboard thereupon and/or securely holding a snowboard thereupon. Or, alternatively, the support surface may be approximately flat and/or approximately level.

In one aspect of the present invention, support surface 404 may be fabricated from a textured or other non-slip material to minimize slippage of the snowboard from support surface 404 during use of support apparatus 400. In embodiments of the present invention having such a feature, sand, silica, or similar abrasive materials may be added to the fabrication material prior to molding or other fabrication of support apparatus 400 to minimize the cost and/or time required to create such non-slip surface. Furthermore, when such a method of manufacturing is incorporated, support apparatus 400 is wholly comprised of a tractable, nonslip material that cannot wear off or otherwise deteriorate with use since the tractable, nonslip material is incorporated consistently throughout support apparatus 400. Alternatively, nonslip pads or the like could be added to support surface 404 via the use of adhesive or the like. However, the sand-augmented, or otherwise augmented, material is preferable as it continues to provide a tractable, nonslip surface as the outer layers of support apparatus 400 wear away. In addition, a coarse finish (e.g., a matte finish) may be incorporated in lieu of a smooth finish (e.g., a gloss finish) to further prevent slippage.

Other features may also be added to support apparatus 400 during the manufacturing process. For example, a logo or other image may be included on support surface 404, upper and/or lower boot interface 402 and 403, respectively, and/or rear surface 408 (FIG. 4B). Support apparatus 400 could also optionally include security indicators with serial number, universal product codes ("UPC codes"), nametag, or the like for identification purposes. Identification may be required, for example, if a snowboarder's boots to which support apparatus 400 are mounted are lost or stolen. In one embodiment of the present invention, the form of identification is permanently incorporated in the support apparatus by molding it therein during the single step molding process as discussed above, thereby minimizing the possibility of removal of such identification. However, other non-molding methods of manufacturing may be incorporated without departing from the scope hereof. Also, other non-molding methods of attaching forms of identification may be substituted without departing from the scope of the present invention.

Figure 4D:
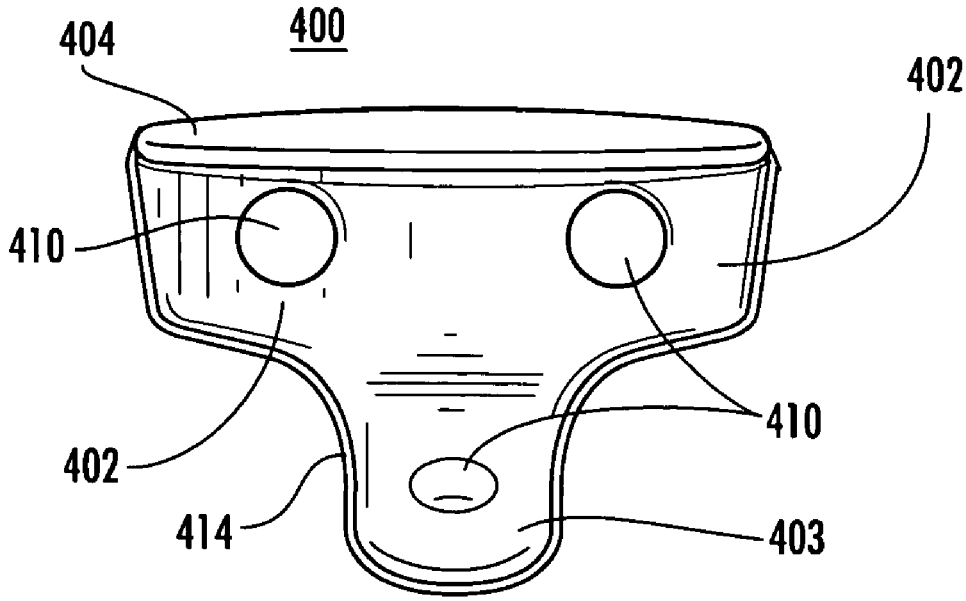
FIG. 4D depicts a front view of a support apparatus in accordance with the embodiment of the present invention depicted in FIGS. 4A-4D.

Referring now to FIG. 4B, depicted is a rear view of support apparatus 400 prior to attachment to a boot in accordance with one embodiment of the present invention. Rear surface 408 extends from the distal edge of support surface 404 to the perimeter of lower and upper boot interfaces 402 and 403, respectively (FIGS. 4A, 4C, and 4D). Although rear surface 408 may be shaped in any form without affecting the primary utility of support apparatus 400, in some embodiments of the present invention, it is angled from the distal edge of support surface 404 to the bottommost end of lower boot interface 403 as depicted in the side view of FIG. 4C. Such angling allows support apparatus 400 to be attached to a boot such that upper boot interface 402 contacts the rearwardly facing surface of the heel of the boot and lower boot interface 403 contacts the downwardly facing surface of the heel of the boot. Such attachment firmly secures support apparatus 400 to the boot and minimizes the possibility of support apparatus 400 becoming detached therefrom.

As depicted in FIG. 4B, rear surface 408 includes recesses 412, wherein each recess 412 has a bore 410 extending from the center thereof throughout support apparatus 400. Bores 410 facilitate attachment of support apparatus 400 to a boot as described in greater detail below with respect to FIGS. 5A-5B. In some embodiments of the present invention, bores 410 are threaded to further secure support apparatus 400 to a boot, however such bores may be unthreaded without departing from the spirit of the present invention. Recesses 412 are indentions in rear surface 408 that surround the perimeter of an end of each bore 410 such that, after attachment of support apparatus 400 to a boot via fasteners such as fasteners 504 (FIGS. 5A-5B), the heads of fasteners 504 (FIGS. 5A-5B) do not protrude beyond rear surface 408. Additionally, recesses 412 may be textured to further secure fasteners 504 thereto. Although three bores 410 are included in the depicted embodiment of the present invention, other quantities and configurations of bores 410 may be included without departing from the spirit of the present invention.

Referring now to FIG. 4C, depicted is a side view of support apparatus 400 illustrating potential external configurations for upper and lower boot interfaces 402 and 403, respectively, and rear surface 408. However, varying external configurations may be substituted for either upper and lower boot interfaces 402 and 403, respectively, and/or rear surface 408 without departing from the scope of the present invention.

Turning next to FIG. 4D, depicted is a front view of support apparatus 400 prior to attachment to a boot in accordance with an embodiment of the present invention. Bores 410, as discussed above with respect to FIG. 4B, extend from recesses 412 (FIG. 4B) throughout support apparatus 400 through the face of upper and lower boot interfaces 402 and 403, respectively. Attachment of support apparatus 400 to a boot via fasteners inserted through bores 410 and threaded into the boot causes upper and lower boot interfaces 402 and 403, respectively, to become approximately flush with the contacted surface of the boot resulting in an about horizontal, slightly inclined support surface 404. Use of a compressible or semi-compressible material, as compared to a more rigid material, for support apparatus 400 maximizes the area of upper and lower boot interfaces 402 and 403, respectively, that physically contact the boot since such a material allows support apparatus 400 to be tightened to the boot until maximum contact is achieved. The compressible material allows the portion of support apparatus 400 first contacting the boot to compress such that the remainder of support apparatus 400 achieves physical contact with the boot as snowboard apparatus 400 is tightened to the boot. In contrast, use of a pliable material, as compared to a more rigid material, for support apparatus 400 maximizes the area of upper and lower boot interfaces 402 and 403, respectively, that physically contact the boot since such a material allows support apparatus 400 to be molded to the boot after attachment until maximum contact is achieved. After attachment of support apparatus 400 to a boot, the pliable material allows the portion of support apparatus 400 that is not in contact with the boot to be manually molded until the entire support apparatus 400 achieves physical contact with the boot. In one such embodiment of the present invention, the perimeter of upper and lower boot interfaces 402 and 403, respectively, includes a lip such as lip 414 that may be manually molded to the boot after installation of support apparatus 400. Another example of such lip is lip 614 as depicted in FIG. 6C and discussed in greater detail below.

Figure 5A:
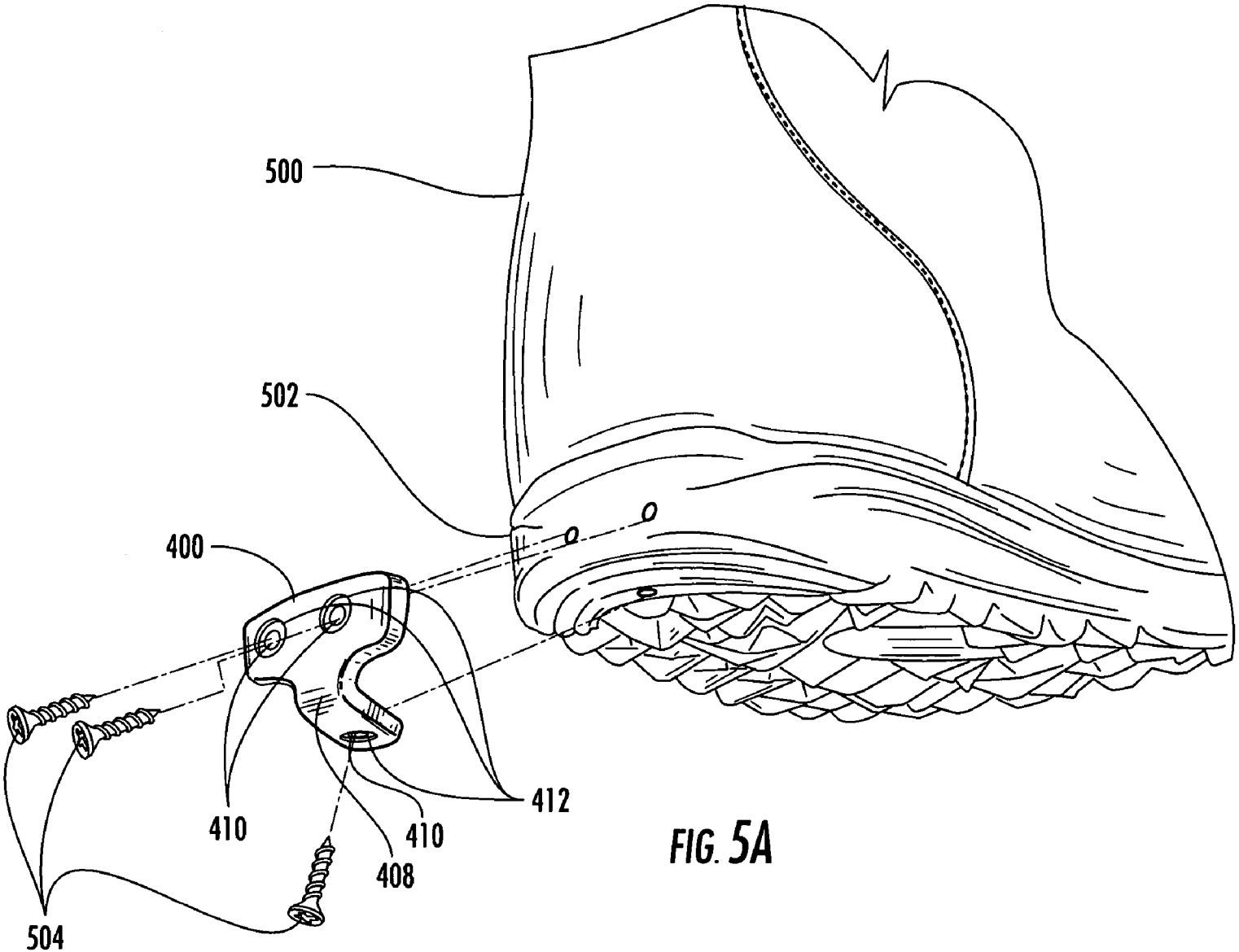
FIG. 5A depicts an angled rear view of a boot and an exploded view of the attachment of a support apparatus in accordance with the embodiment of the present invention depicted in FIGS. 4A-4D.

Referring next to FIG. 5A, depicted is boot 500 prior to attachment of support apparatus 400 in accordance with an embodiment of the present invention. Support apparatus 400 is secured to sole 502 of boot 500 via fasteners 504. Typically, the support apparatus such as support apparatus 400 will be affixed to the boot that is unbound from the snowboard when walking, riding a chair lift, etc. Prior to attachment, support apparatus 400 is placed in the desired location on boot 500. Although the preferred location of the support apparatus will vary between differing boot styles and models, such location is optimally one in which the support apparatus does not interfere with the respective binding when the boot is bound to the snowboard. Furthermore, in embodiments of the present invention incorporating fasteners, the support apparatus is ideally installed at a relatively low position upon the heel of the boot such that lower boot interface 403 contacts the downwardly facing surface of the heel of boot 500 and/or sole 502.

After the proper location has been determined, a fastener 504 may be used to create a pilot hole, however, fasteners 504 may also be installed directly into boot 500 and/or sole 502 without the use of one or more pilot holes. Fastener 504 may then be threaded or otherwise inserted into sole 502 to ensure that such fastener does not penetrate the interior region of boot 500. Fastener 504 may then be removed and re-inserted through bores 410 until the head of each fastener is within its respective recess 412 such that the head does not protrude beyond rear surface 408 of support apparatus 400 and lower and upper boot interfaces 402 and 403, respectively, (FIGS. 4A, 4C, and 4D) are approximately flush with the respective external surfaces of boot 500 and/or sole 502. In one aspect of the present invention, fasteners 504 are pointed screws having threads (e.g., high/low threads) or thread like configurations (e.g., saw tooth) having a length of approximately three quarters of one inch, however, other types of fasteners having varying lengths and/or varying threads or thread styles may be substituted without departing from the scope hereof. Also, to further secure support apparatus 400 to boot 500, an adhesive may be applied to lower and/or upper boot interfaces 402 and 403, respectively, and/or fasteners 504 prior to installation of support apparatus 400. However, support apparatus 400 may be installed without adhesive or the like such that it may be removed as desired by the snowboarder without departing from the scope of the present invention. Such an embodiment may be desired, for example, if support apparatus 400 is fabricated with a plurality of colors and/or patterns. Such removability allows the snowboarder to coordinate support apparatus 400 to his or her clothing, boots, snowboards, or other articles.

Figure 5B:
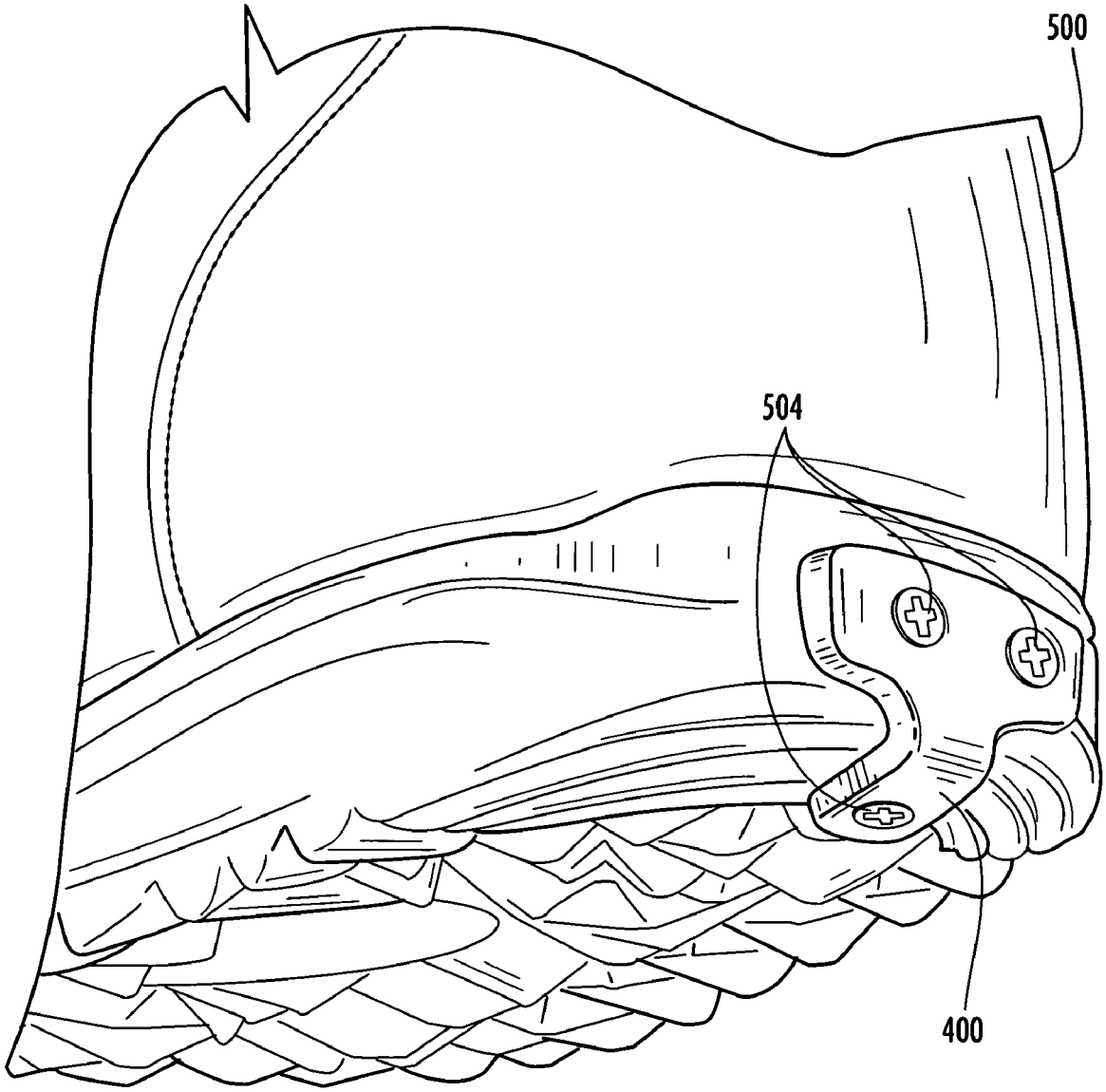
FIG. 5B depicts an angled rear view of a support apparatus secured to a boot in accordance with the present invention.

FIG. 5B depicts support apparatus 400 after attachment to boot 500 via fasteners 504. Permanent attachment of support apparatus 400 to boot 500 is possible due to the unobtrusive nature of support apparatus 400, and such attachment minimizes the snowboarder's preparation time prior to snowboarding (i.e., the time associated with continually reinstalling snowboard apparatus 400).

Figure 5C:
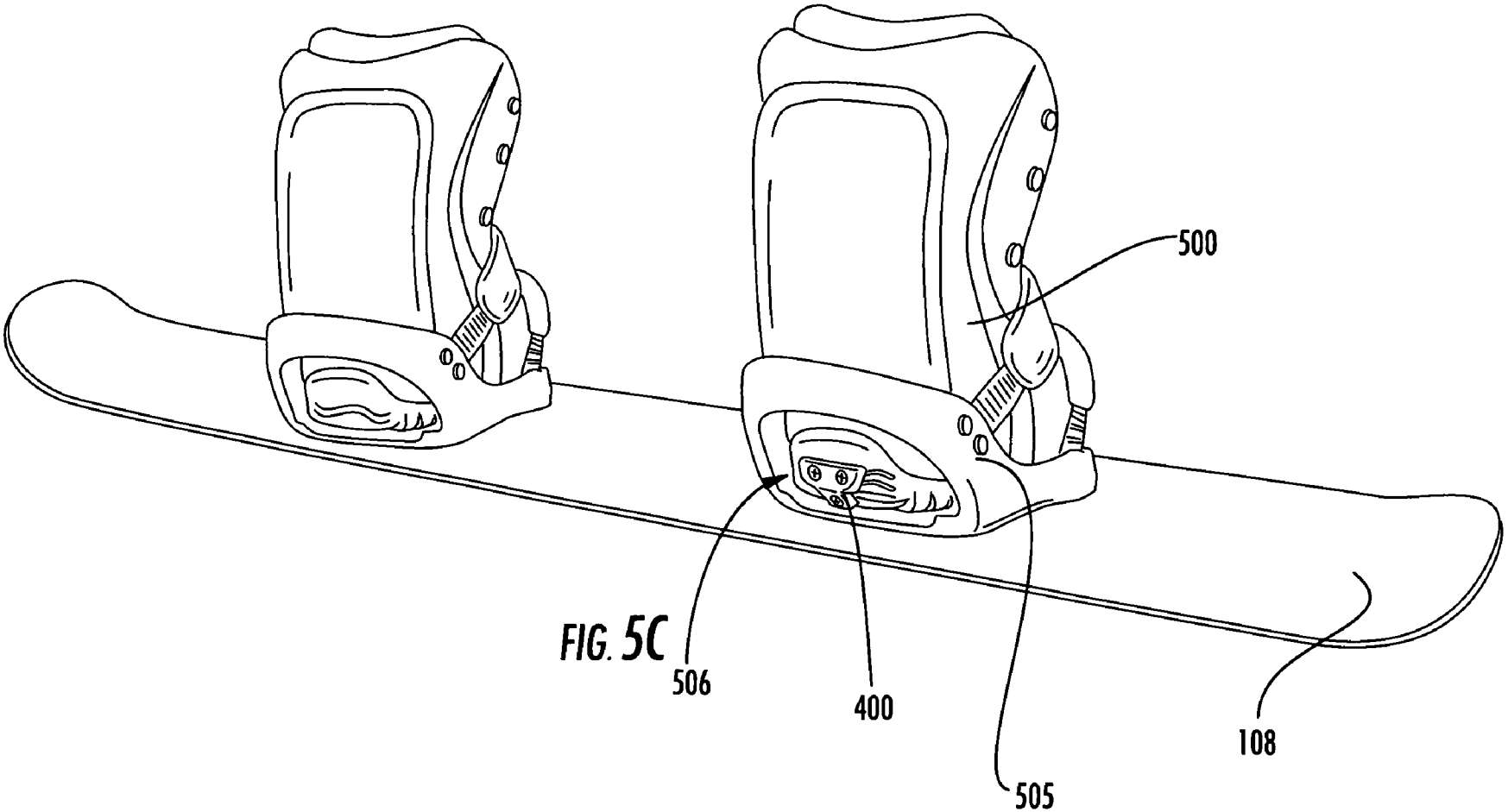
FIG. 5C depicts a rear view of a boot equipped with a support apparatus inserted into a snowboard binding in accordance with the present invention.

Turning now to FIG. 5C, depicted is boot 500 secured to a snowboard such as snowboard 108 after attachment of support apparatus 400 thereto. Boot 500 is attached to snowboard 108 via binding 505 as is conventionally known in the art. Commercially available bindings typically include an open area, such as binding aperture 506, wherein the heel of the boot is placed during attachment thereof to a snowboard. The position of typical binding apertures 506 allow a boot 500, with support apparatus 400 attached thereto, to be secured to binding 505 without obstruction of the binding mechanism by support apparatus 400. Due to the unique design of the present invention, support apparatus 400 is an unobtrusive supplement to existing boot and binding systems that does not require the purchase of additional or custom equipment.

Referring now to FIGS. 6A-6D, depicted are front views of support apparatus 600*a*-600*d* having integral fasteners in accordance with multiple embodiments of the present invention. Similar to support apparatus 400, support apparatus 600*a*-600*d* include, inter alia, boot interfaces 602*a*-602*d*, respectively, and support surfaces 604*a*-604*d*, respectively. Also, support apparatus 600*a*-600*d* may be fabricated using similar materials and methods to those discussed above with respect to support apparatus 100 and 400 as described with respect to FIGS. 1 and 4A-4D. Additionally, support apparatus 600*a*-600*d* provides the same utility as support apparatus 100 and 400 as described above with respect to FIGS. 1 and 4A-4D.

In contrast to support apparatus 400, support apparatus 600*a* includes one or more pegs 606 in lieu of bores 410 and recesses 412. In the embodiment of the present invention depicted in FIG. 6A, peg 606 extends about perpendicularly from boot interface 602*a*. Peg 606 may be formed as an integral part of support apparatus 600*a* (e.g., as a part of a single or multiple step molding process). Alternatively, peg 606 may be attached after manufacture of support apparatus 600*a* without departing from the scope of the present invention. In the embodiment of the present invention depicted in FIG. 6A, peg 606 extends about one quarter of one inch from boot interface 602*a*, however, varying peg lengths may be incorporated without departing from the present invention.

In one aspect of the present invention, peg 606 includes grooves to further secure support apparatus 600*a* to a boot such as boot 700 as described in greater detail below with respect to FIG. 7A. However, alternate peg embodiments may be substituted without departing from the scope hereof. For example, peg 606 may be threaded or otherwise formed to mate with a specific type of aperture in the boot. Such apertures may be square, hexagonal, octagonal, or the like to facilitate attachment of support apparatus 600*a* to the boot and/or to prevent peg 606 from rotating once attached to the boot.

Figure 6A:
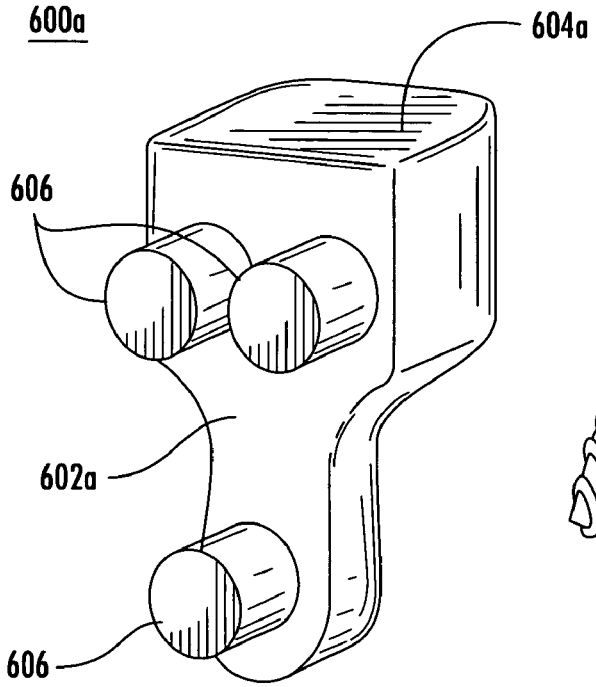
FIG. 6A depicts a front view of a support apparatus having integral peg fasteners in accordance with an alternate embodiment of the present invention.

Although FIG. 6A depicts support apparatus 600*a* with a support surface 604*a* having a width less than the height of boot interface 602*a*, embodiments having varying dimensions may be substituted without departing from the scope of the present invention. Such varying dimensions may be incorporated to facilitate creation of a plurality of specific support apparatus, wherein each support apparatus is intended for boots, bindings, and/or snowboards having a specific manufacturer and/or a specific model. Or, alternatively, the support apparatus may be generic to accommodate use with boots, bindings, and snowboards of any make or model.

Figure 6B:
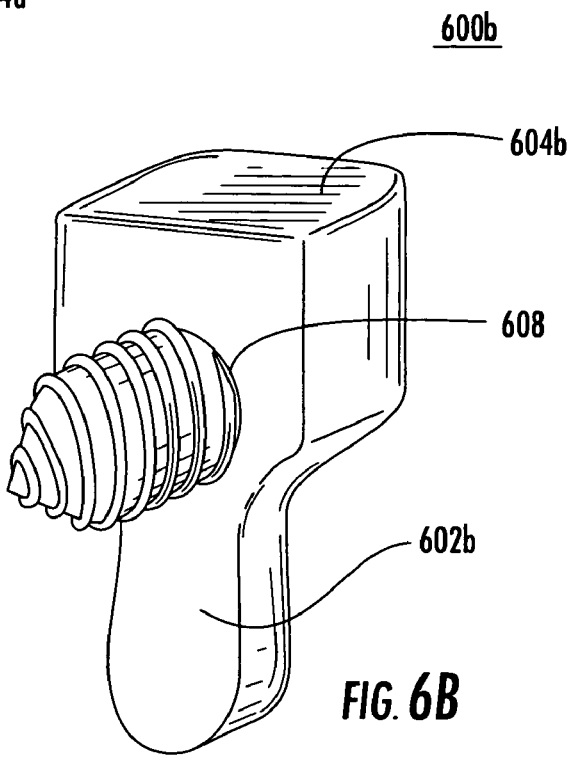
FIG. 6B depicts a front view of a support apparatus having an integral threaded fastener in accordance with an alternate embodiment of the present invention.
Figure 6C:
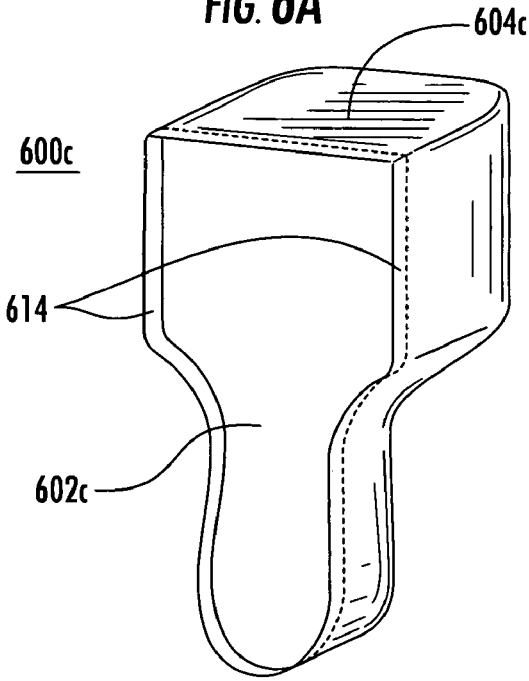
FIG. 6C depicts a front view of a support apparatus fastened with an adhesive in accordance with an alternate embodiment of the present invention.

Turning next to FIG. 6B, support apparatus 600*b* includes one central threaded peg 608, which extends about perpendicularly from boot interface 602*b*. Peg 608 may be formed as an integral part of support apparatus 600*b* (e.g., as a part of a single or multiple step molding process). Alternatively, peg 608 may be attached after manufacture of support apparatus 600*b* without departing from the scope of the present invention. In the embodiment of the present invention depicted in FIG. 6B, peg 608 extends about one quarter of one inch from boot interface 602*b*, however, varying peg lengths may be incorporated without departing from the present invention.

In one aspect of the present invention, peg 608 is threaded and includes a pointed end. Such configuration allows support apparatus 600*b* to be secured to a boot by placing it in the desired location relative to the boot, beginning a hole by pressing the point of peg 608 into the boot, and simply rotating support apparatus 600*b* while applying pressure to it such that peg 608 threads into the sole or other portion of the boot. However, alternate peg embodiments may be substituted without departing from the scope hereof. For example, the boot may have a preformed, threaded bore configured to mate with peg 608, thereby allowing a user to simply thread peg 608 into the bore.

Referring now to FIG. 6C, support apparatus 600*c* includes a bare boot interface 602*c*. In one aspect of the present invention, adhesive is applied to boot interface 602*c*, after which boot interface 602*c* may be held in place in the desired location adjacent to the boot until the adhesive completely adheres support apparatus 600*c* to the boot. However, alternate embodiments are envisioned in which adhesive is applied with a protective cover to boot interface 602*c* during manufacturing and a user simply peels the protective cover before attaching support apparatus 600*c* to a boot via the adhesive. In one such embodiment of the present invention, the perimeter of boot interface 602*c* includes a lip such as lip 614 that may be manually molded to the boot after installation of support apparatus 602*c*.

Figure 6D:
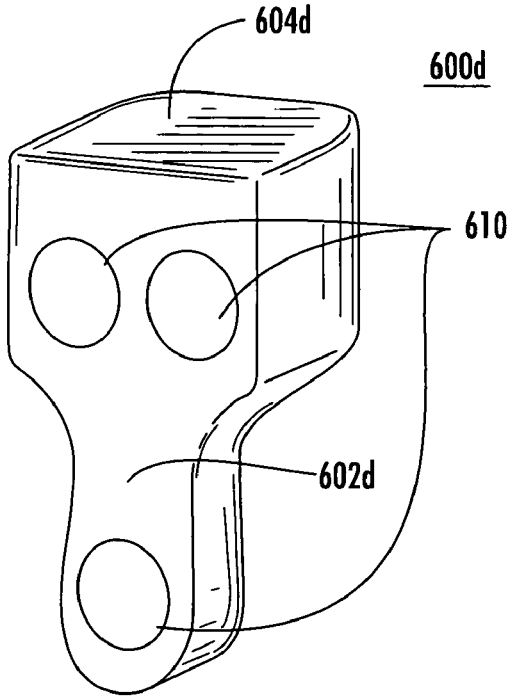
FIG. 6D depicts a front view of a support apparatus having bores through which fasteners pass in accordance with an alternate embodiment of the present invention.

FIG. 6D depicts support apparatus 600*d*, which includes bores 610 penetrating therethrough and through the face of boot interface 602*d*. Support apparatus 600*d* may be installed via fasteners similar to the installation described above for support apparatus 400. However, in the embodiment of the present invention depicted in FIG. 6D, boot interface 602*d* contacts only the rear surface of the heel of a boot (i.e., boot interface 602*d* does not contact the downwardly facing surface of the heel and/or sole of the boot).

Although support apparatus 400 and 600*a*-600*d* include attachment mechanisms such as fasteners, pegs, adhesive, and the like for securing such support apparatus to a boot, sole, or a sub-component thereof, other methods of securing a support apparatus are envisioned without departing from the scope of the present invention. For example, a support apparatus may be sewn to the rearward portion of the boot, sole, or a sub-component thereof. Or, magnets may be incorporated to retain support apparatus affixed to a boot. Or nonremovable, locking push pin mechanisms may be incorporated. In yet another embodiment, hooking mechanisms may be used. Or, fasteners with a contracting and expanding end may be forced into a compatible bore, after which the contracting and expanding end expands to prevent removal of the fastener from the bore. Or, in yet another embodiment, the support apparatus is affixed to the boot via use of a zip tie, cable tie, wire tie, or the like. Virtually any method of securing a support apparatus to a boot, sole, or a sub-component thereof may be substituted without departing from the scope of the present invention In one embodiment of a present invention in which a support apparatus is affixed to a boot, sole, or a sub-component thereof via a zip tie, cable tie, wire tie, or the like, a plurality of bores may be formed through the boot, sole, or a sub-component thereof such that the bores penetrate the inwardly facing surface of the interior region of the boot (i.e., the region in which the snowboarder's foot is placed). Thereafter, the zip tie, cable tie, wire tie, or the like may be looped through the bores and the support apparatus and tightened such that the support apparatus is firmly secured to the boot.

Figure 7A:
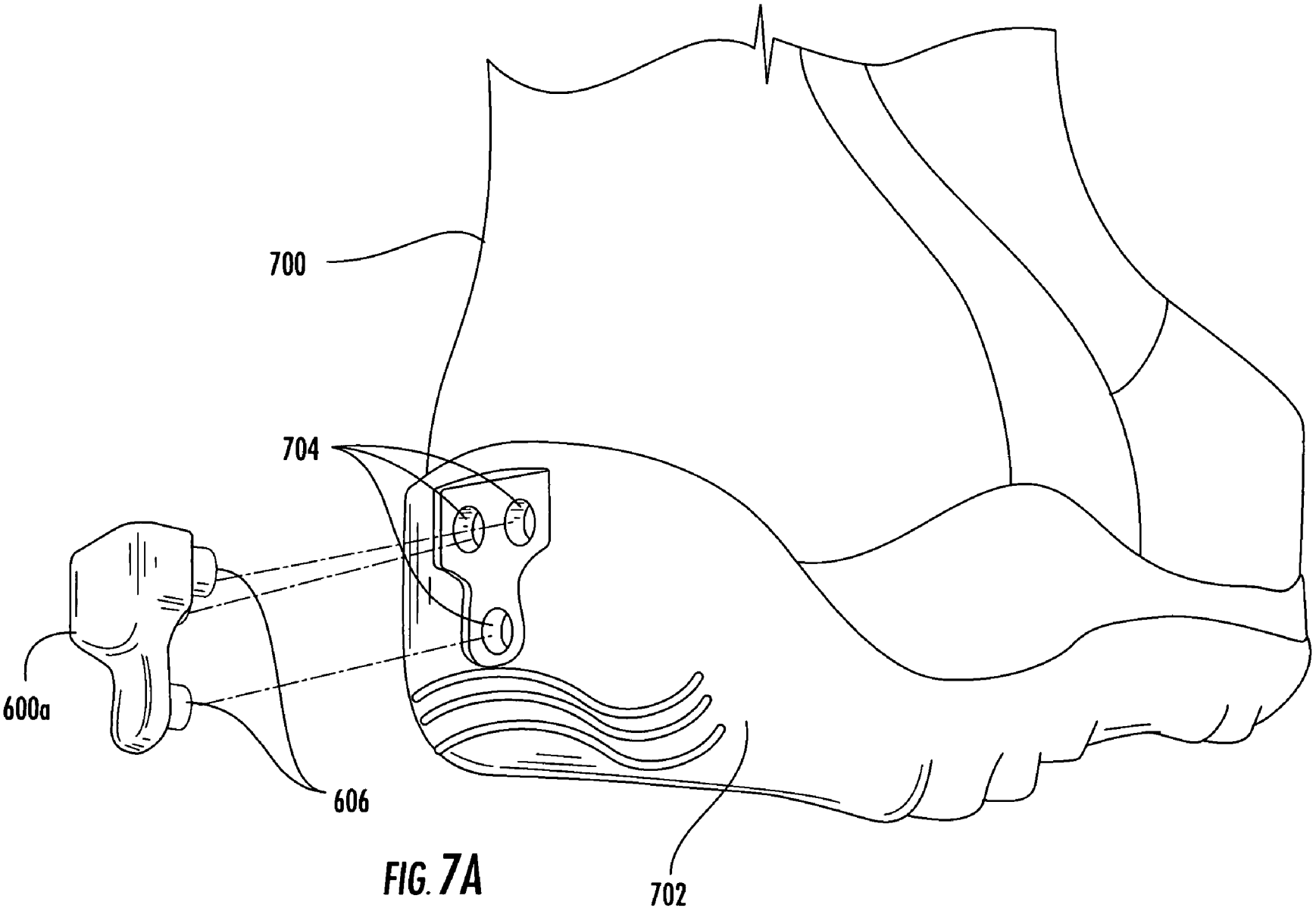
FIG. 7A depicts an angled rear view of a boot having preformed bores and an exploded view of the attachment of a support apparatus having integral fasteners compatible with the preformed bores in accordance with the embodiment of the present invention depicted in FIG. 6A.

Referring next to FIG. 7A, depicted is boot 700 prior to insertion of support apparatus 600*a* in accordance with an embodiment of the present. Boot 700 includes bores 704 within sole 702. Bores 704 may be fabricated in boot 700 by the snowboarder, a snowboard professional, or the like, or boots 700 may be pre-fabricated by the boot manufacturer to include bores 704. Bores 704 may be created using any one of a variety of methods including, but not limited to, via a drill and drill bit combination, via a specially configured tool possibly sold and/or distributed with the support apparatus, via a wide diameter screw, via a razor, via a cutting blade, and via melting (e.g., with a lighter, glue gun, sottering iron, etc.). Bores 704 may form virtually any shape so long as they are capable of mating with pegs 606 of support apparatus 600*a* (e.g., pegs 606 and bores 704 may be inversely threaded). Furthermore, bores 704 may be square, hexagonal, octagonal, or the like to prevent peg 606 from rotating once installed within a respective bore 704.

When bores 704 are installed in boot 700 by the manufacturer of the boot, the manufacturer may select the bore to be compatible with a specific support apparatus manufactured by a third-party. Or, the manufacturer may sell its own support apparatus compatible with the preformed bores 704 inherent in the manufacturer's boots. Such apparatus may be sold as an add-on accessory or with the boot.

Figure 7B:
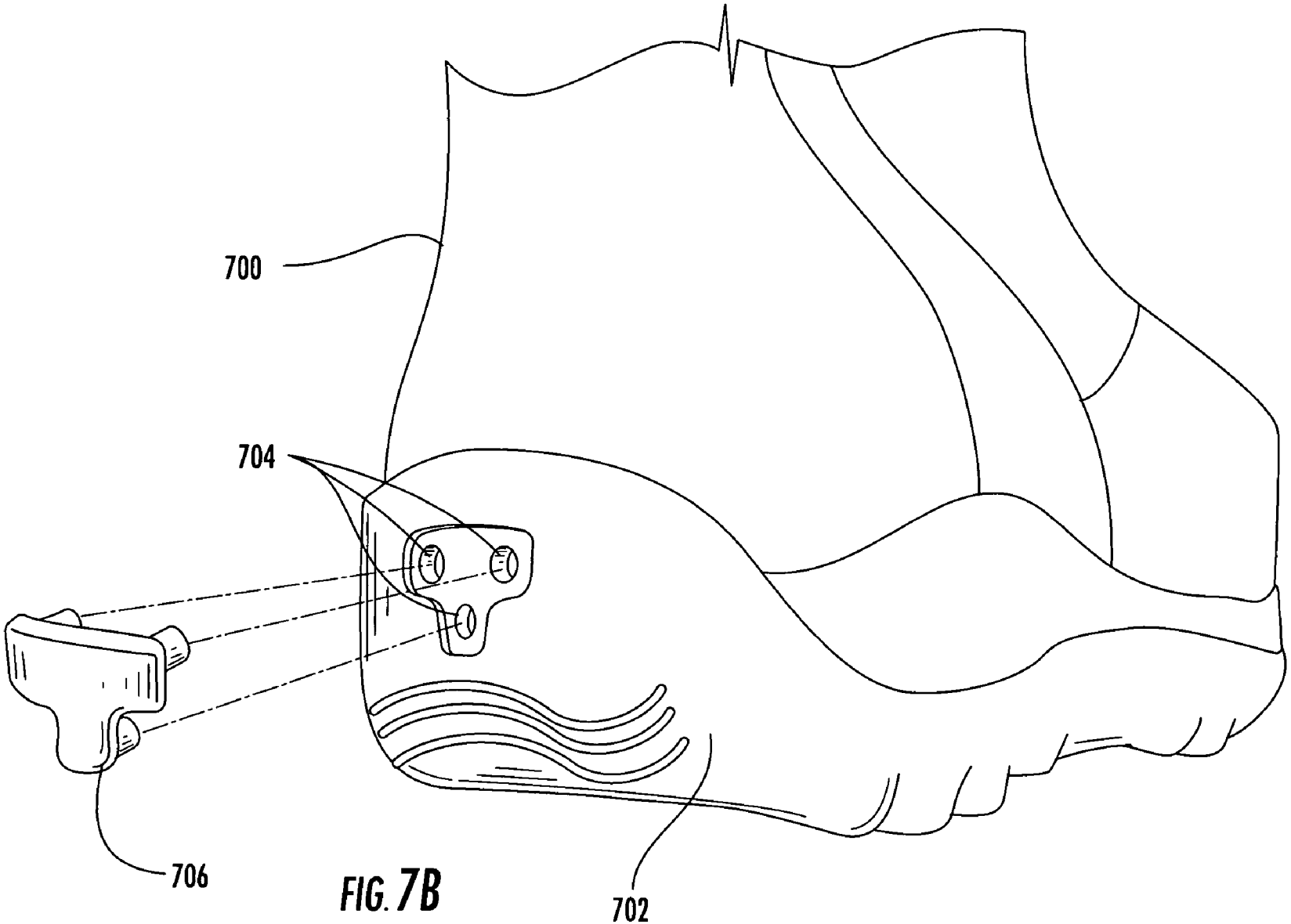
FIG. 7B depicts an angled rear view of a boot having preformed bores and an exploded view of the attachment of a cap having integral fasteners compatible with the preformed bores in accordance with an embodiment of the present invention.

Referring now to FIG. 7B, in some embodiments of the present invention, both boots may be manufactured with preformed bores 704 or the like. However, the user may decide to install a support apparatus on only one boot. In such case, the user may insert a cap, insert, panel, or the like compatible with bores 704 in the boot in which the support apparatus is not installed such as cap 706 as depicted in FIG. 7B. In some aspects of the present invention such cap, insert, panel, or the like is manufactured from the same material as sole 702 or another location into which bores 704 or the like are located such that it meshes with its surrounding area. In other aspects of the present invention, such cap, insert, panel, or the like is a decorative item. In such cases, a snowboarder may coordinate cap 706 or the like to his or her clothing, boots, snowboards, or other articles. Or a snowboarder may otherwise show his or her style through selection of a cap including messages, statements, slogans, logos, and the like.

Referring back to FIG. 7A, bores 704 may include a simple bore created within boot 700 or the sole or other subcomponent thereof, or bores 704 may include hardware inserted or otherwise installed or manufactured with boot 700 or the sole or other subcomponent thereof. For example, bores 704 may include metallic hardware or similar inserts that reinforce bores 704 to provide a more durable seat for peg 606 or the like such as a nut and bolt combination. Such hardware may be locking or non-locking, wherein the former embodiments may allow a support apparatus such as support apparatus 600*a* to be locked in place. Also, such hardware may allow the snowboarder to disengage the hardware when it is not required (e.g., during transportation, while resting, etc.) via disengagement means such as retractable hardware, locking and unlocking pushbutton hardware, rotating hardware (i.e., the hardware is rotated away from the boot during use and is rotated toward or into the boot when not in use), or the like. Or, furthermore, the hardware may wrap be suspended from the boot via a strap, wherein the strap may be affixed to the boot in any one of a variety of methods including wrapping the strap around the boot, attaching the strap to the boot via a magnetic device, and the like. Virtually any hardware capable of supporting the toe edge of a snowboard adjacent the heel of an unbound boot may be incorporated without departing from the scope of the present invention.

Once bores 704 are created within sole 702, pegs 606 may be inserted therein. Prior to insertion of pegs 606 into bores 704, an adhesive may be applied to pegs 606, bores 704, or both to permanently secure support apparatus 600*a* to boot 700. Any commercial known adhesive may be used provided that the adhesive is cohesive to both pegs 606 and sole 702 or bores 704. Permanent attachment of support apparatus 600*a* to boot 700, as well as attachment of support apparatus 600*b*-600*d* and the other embodiments of the support apparatus discussed herein to one or more boots, is possible due to the unobtrusive nature of support apparatus 600*a*, and such attachment minimizes the snowboarder's preparation time prior to snowboarding (i.e., the time associated with continually reinstalling snowboard apparatus 600*a*). However, pegs 606 may be installed without adhesive or the like such that it may be removed as desired by the snowboarder without departing from the scope of the present invention. Such an embodiment may be desired, for example, if support apparatus 600*a* is fabricated with a plurality of colors and/or patterns. Such removability allows the snowboarder to coordinate support apparatus 600*a* to his or her clothing, boots, snowboards, or other articles.

Figure 8A:
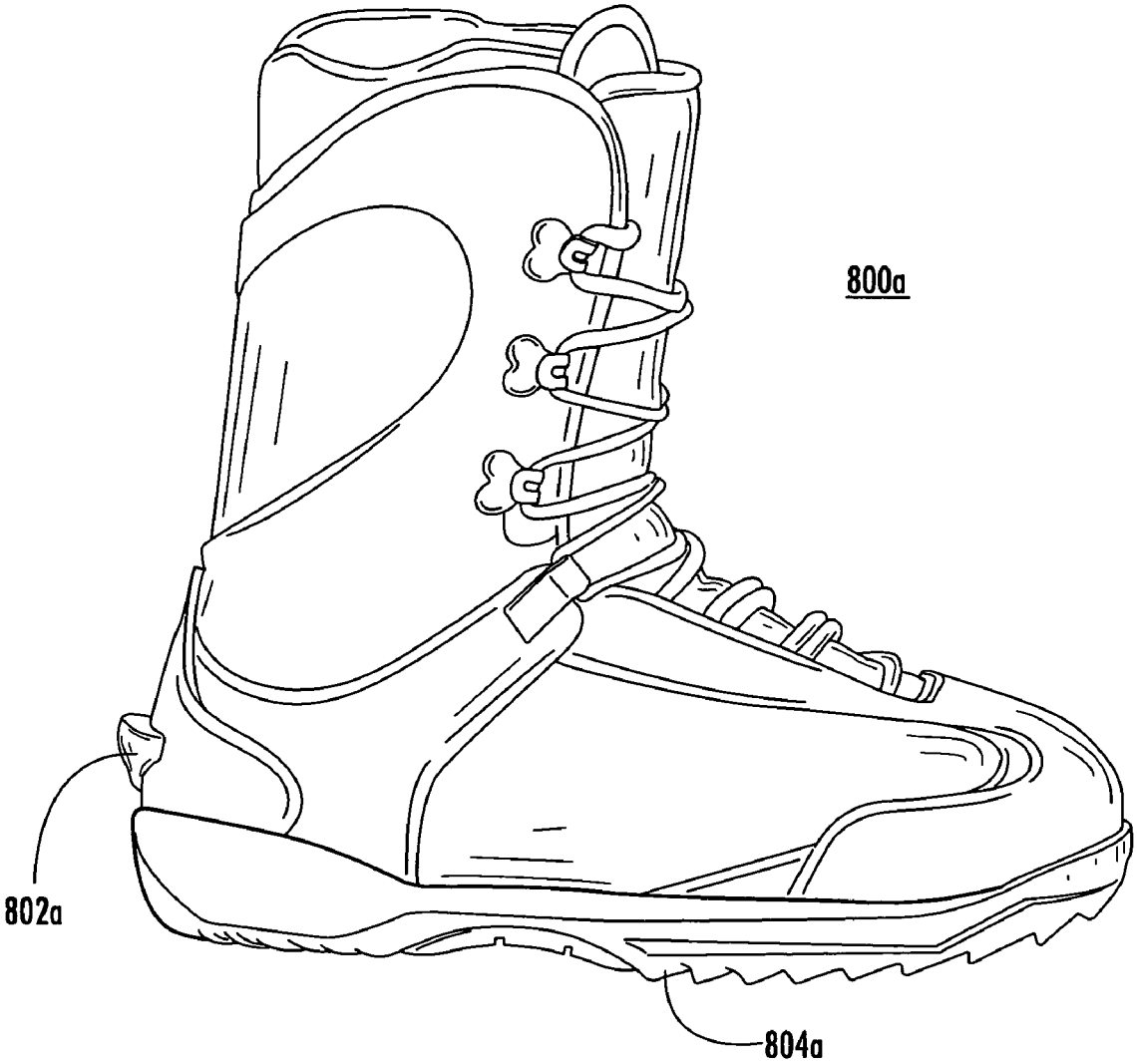
FIG. 8A depicts a side view of a boot with a support integral to a boot in accordance with one embodiment of the present invention.
Figure 8B:
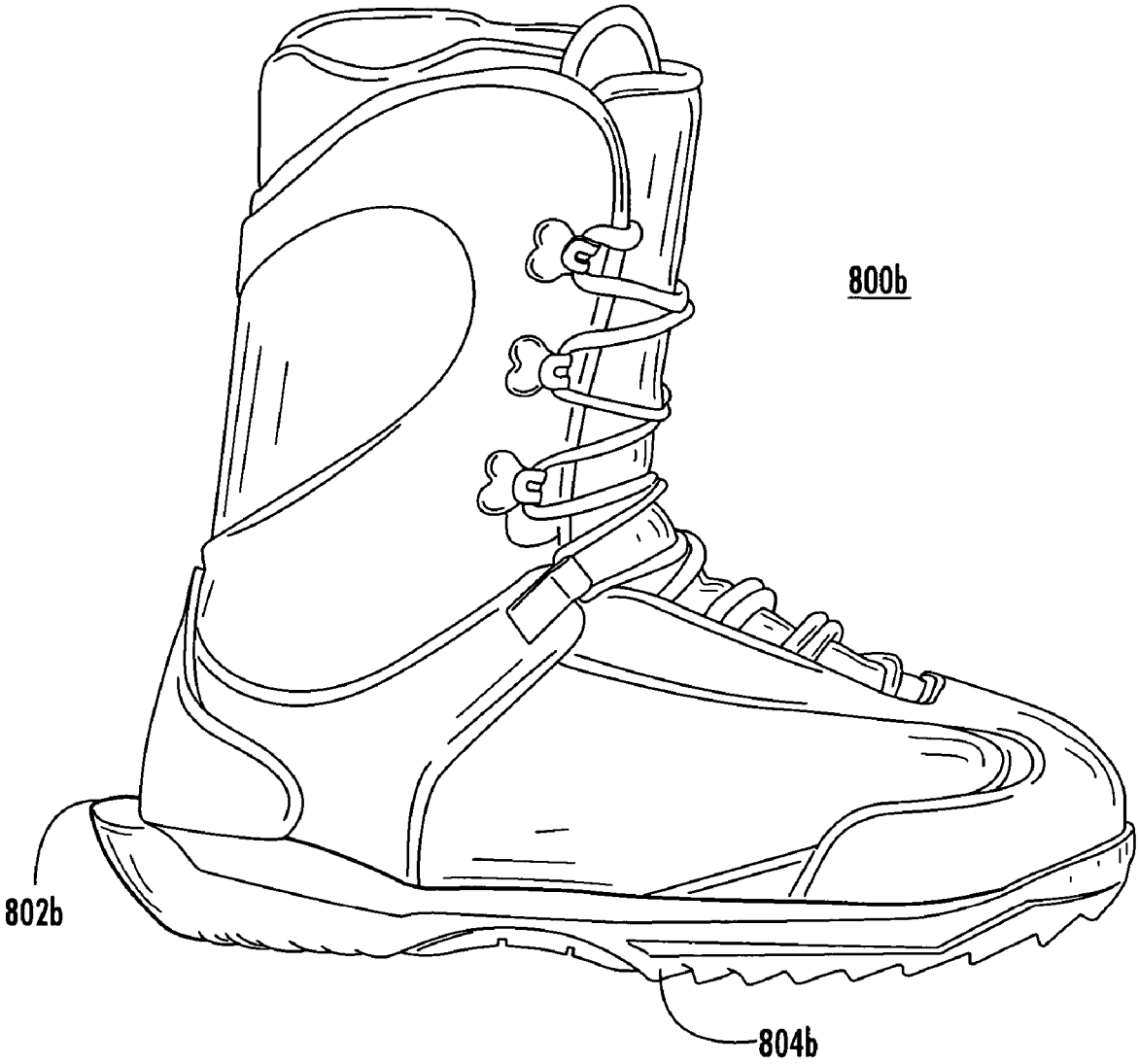
FIG. 8B depicts a side view of a boot with a support integral to a sole of a boot in accordance with one embodiment of the present invention.
Figure 8C:
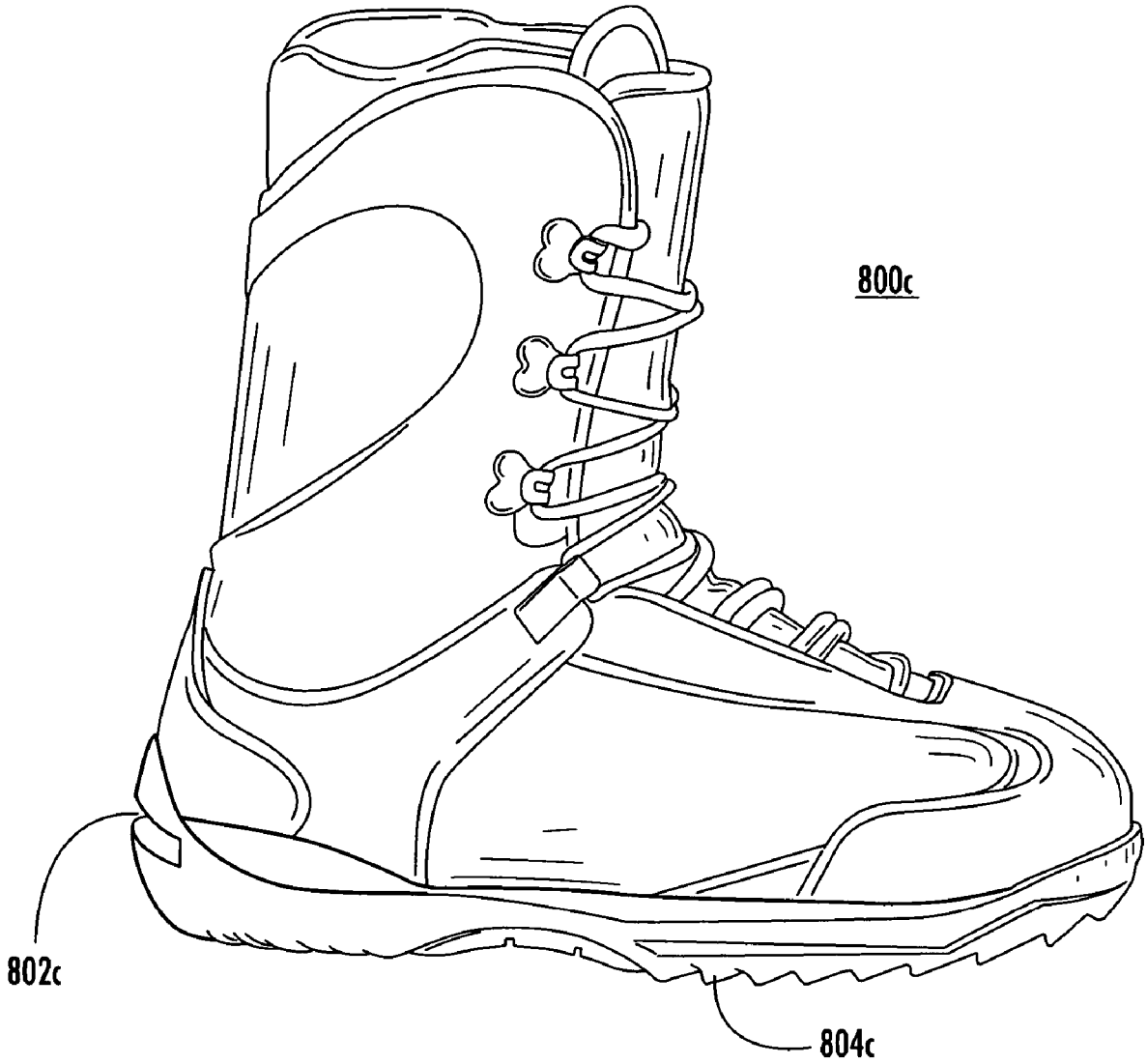
FIG. 8C depicts a side view of a boot with an integral support manufactured as an indent or cutout of the sole of a boot in accordance with one embodiment of the present invention.

Referring now to FIGS. 8A-8C, depicted are boots 800*a*-800*c*, respectively, wherein a snowboard support is an integral component of boots 800*a*-800*c*. First, depicted in FIG. 8A is boot 800*a* including support 802*a*. In this embodiment of the present invention, support 802*a* may be shaped similar to support apparatus 400 or 600*a*-600*d* as described above, however, snowboard support 802*a* is manufactured as an integral component of boot 800*a*, sole 804*a*, or a sub-component thereof. For example, support 802*a* may be fabricated from the same material as boot 800*a*, sole 804*a*, or a sub-component thereof to allow support 802*a* to be formed together therewith (e.g., during a single step injection molding process). Or, alternatively, support 802*a* may be a separate apparatus permanently or non-permanently affixed to boot 800*a*, sole 804*a*, or a sub-component thereof by the manufacturer of boot 800*a*, sole 804*a*, or a sub-component thereof, respectively, prior to sale of such boot, sole, or a sub-component thereof. Such method of affixation may be as described herein or as otherwise known in the art without departing from the scope of the present invention.

Turning now to FIG. 8B, depicted is boot 800*b* including support 802*b*. In this embodiment of the present invention, support 802*b* may be shaped similar to support apparatus 400 and/or 600*a*-600*d* as described above, however, snowboard support 802*a* is manufactured as an integral component of or extension of sole 804*b*. For example, support 802*b* may be fabricated from the same material as sole 804*b* to allow support 802*b* to be formed together therewith (e.g., during a single step injection molding process). Or, alternatively, support 802*b* may be a separate apparatus permanently or non-permanently affixed to sole 804*b* thereof by the manufacturer of sole 804*b* prior to sale of such sole. Such method of affixation may be as described herein or as otherwise known in the art without departing from the scope of the present invention.

Figure 9:
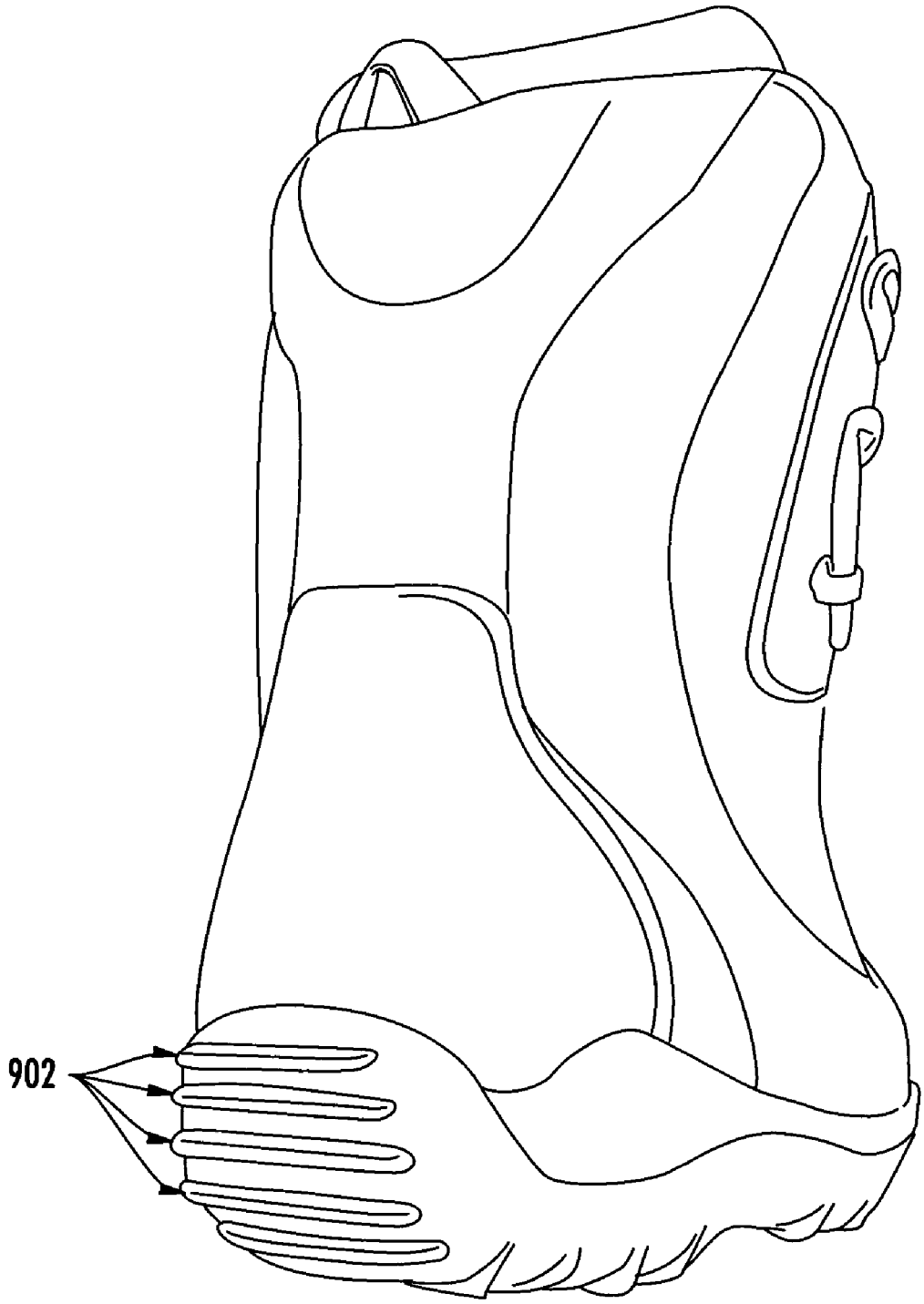
FIG. 9 (PRIOR ART)
FIG. 9 depicts a rear view of a boot including the treads located on the soles thereof in accordance with the prior art.

In some embodiments of the present invention, support 802*b* may involve simply extending the ridge located along the upwardly facing edge of the sole of a typical boot such that such edge forms a ledge, support surface, or the like as described herein. Or, similarly, in accordance with the systems and methods of the present invention, support 802*b* may be achieved by simply extending one or more treads of the sole of a typical boot such as treads 902 as depicted in FIG. 9, such that the tread is of sufficient depth to form a ledge, support surface, or the like as described herein. Referring now to FIG. 8C, depicted is boot 800*c* including integral support 802*c*. In this embodiment of the present invention, support 802*c* may be manufactured as an indent or cutout of boot 800*c*, sole 804*c*, or a subcomponent thereof. Or, alternatively, integral support 802*c* may include hardware inserted or otherwise installed or manufactured within such indent or cutout of boot 800*c*, sole 804*c*, or a sub-component thereof. For example, integral support 802*c* may include metallic hardware or similar inserts that reinforce integral support 802*c* to provide a more durable seat upon which a snowboard may be rested. Such hardware may be locking or non-locking, wherein the former embodiments may allow a snowboard to be locked in place. Or, alternatively, integral support 802*c* may be lined with a material that does not damage or dull the downwardly facing surface of a snowboard. However, virtually any method of creating an about horizontal surface within the rearward portion of a boot, sole, or a subcomponent thereof upon which a snowboard may be rested may be substituted without departing from the scope of the present invention.

Furthermore, although FIGS. 8A-8C depict inclusion of an integral support apparatus 802*a*-802*c* in a single left boot, support apparatus 802*a*-802*c* may be alternatively included in both of the snowboarder's boots. Such inclusion is likely when support apparatus 802*a*-802*c* is formed during the manufacturing of the boots since the manufacturer has no way of knowing whether the buyer will be a regular-footed or goofy-footed snowboarder. For example, a regular-footed snowboarder is likely to prefer that support apparatus 802*a*-802*c* is included in his or her right boot since the right boot is typically unbound from the snowboard for walking, riding a chairlift, and the like. However, a goofy-footed snowboarder is likely to prefer that support apparatus 802*a*-802*c* is included in his or her left boot since the left boot is typically unbound from the snowboard for walking, riding a chairlift, and the like. Therefore, inclusion of support apparatus 802*a*-802*c* in both boots ensures that the support apparatus is compatible for use with all snowboarders. Furthermore, creating all boots with the same support apparatus 802*a*-802*c* is likely to provide easier manufacturing as the manufacturing of two different boots (i.e., one without a support apparatus and one with a support apparatus) is not required.

Inclusion of a support apparatus such as support apparatus 802*a*-802*c* in a boot by the manufacturer provides another advantage to the manufacturer. The manufacturer may form support apparatus such that a boot having such support apparatus is only compatible with a binding manufactured by the boot manufacturer. For example, the manufacturer may create a specially configured notch in the binding to allow the binding to be compatible with the location of the support apparatus on the manufacturer's boot. Consequently, a buyer of the boot having the integral support apparatus must also buy the corresponding boot binding, thereby potentially increasing the manufacturer's binding sales.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. An apparatus for supporting sporting equipment comprising:

at least one boot interface formed to conform with a rearward external surface of a first boot, said rearward external surface located at an end of said first boot opposite a toe of said first boot;

at least one support surface coupled to said boot interface;

wherein a user of said sporting equipment wears said first boot and a second boot;

wherein said sporting equipment is coupled to said second boot; and wherein coupling of said apparatus to said first boot along said boot interface positions said support surface such that said sporting equipment may be easily rested atop said support surface when said user is seated naturally.

2. An apparatus according to claim 1, wherein said apparatus is manufactured from one of the group consisting of urethane, polyurethane, a polymer, rubber, plastic, fiberglass reinforced plastic, and combinations thereof.

3. An apparatus according to claim 1, wherein said resting of said sporting equipment atop said support surface equalizes the load of said sporting equipment between both legs of said user.

4. An apparatus according to claim 1, wherein said sporting equipment is a snowboard.

5. An apparatus according to claim 1, said apparatus further comprising:

at least one attachment mechanism coupled to said boot interface for securing said apparatus to said boot.

6. An apparatus according to claim 1, wherein said support surface is about horizontal.

7. An apparatus according to claim 1, wherein said support surface is a non-slip surface.

8. An apparatus according to claim 7, wherein said non-slip surface is at least one of the group consisting of a textured surface, at least one non-slip pad, a surface containing sand, a surface containing silica, a surface containing an abrasive material, and combinations thereof.

9. An apparatus according to claim 1, said apparatus further comprising:

at least one of the group consisting of a security indicator, a serial number, a universal product code, a nametag, and combinations thereof.

10. An apparatus according to claim 5, wherein said at least one attachment mechanism is at least one of the group consisting of a peg, an adhesive, hardware, a zip tie, a cable tie, a wire tie, a fastener, stitching, a magnet, a locking push pin mechanism, a hooking mechanism, a fastener with a contracting and expanding end, and combinations thereof.

11. An apparatus according to claim 5, wherein said at least one attachment mechanism includes at least one of the group consisting of texture, grooves, threads, and combinations thereof.

12. An apparatus according to claim 1, said apparatus further comprising:

at least one bore extending throughout said apparatus and extending through at least one face of said boot interface; and at least one fastener passing through said at least one bore for fastening said apparatus to said first boot.

13. An apparatus according to claim 12, wherein said at least one fastener is at least one of the group consisting of a screw, a bolt, a rivet, and combinations thereof.

14. An apparatus according to claim 12, wherein an interior of said at least one bore includes at least one of the group consisting of texture, threads, grooves, and combinations thereof.

15. An apparatus according to claim 12, wherein at least one end of said at least one bore is recessed below a surface of said apparatus to prevent a head of said fastener from extending beyond said surface of said apparatus.

16. A supporting boot for supporting sporting equipment comprising:

at least one interior section into which a first foot is placed; and at least one exterior section surrounding said interior section, said exterior section including at least one support surface, said at least one support surface located at a rearward portion of said exterior section, said rearward portion of said exterior section located at an end of said supporting boot opposite a toe of said supporting boot;

wherein a user of said sporting equipment wears said supporting boot on said first foot and wears a non-supporting boot on a second foot;

wherein said sporting equipment is coupled to said non-supporting boot; and wherein said sporting equipment may be easily rested atop said support surface when said user is seated naturally.

17. A supporting boot according to claim 16, wherein said support surface is formed by at least one of the group consisting of an indent, a cutout, an integral support apparatus, an integral support, and combinations thereof.

18. A supporting boot according to claim 16, wherein said support surface is manufactured from at least one of the group consisting of urethane, polyurethane, a polymer, rubber, plastic, fiberglass reinforced plastic, and combinations thereof.

19. A supporting boot according to claim 16, wherein said resting of said sporting equipment atop said support surface equalizes the load of said sporting equipment between both legs of said user.

20. A supporting boot according to claim 16, wherein said sporting equipment is a snowboard.

21. A supporting boot according to claim 16, wherein said support surface is about horizontal.

22. A supporting boot according to claim 16, wherein said support surface is a non-slip surface.

23. A supporting boot according to claim 22, wherein said non-slip surface is at least one of the group consisting of a textured surface, at least one non-slip pad, a surface containing sand, a surface containing silica, a surface containing an abrasive material, and combinations thereof.

24. A supporting boot according to claim 16, said supporting boot further comprising:

at least one of the group consisting of a security indicator, a serial number, a universal product code, a nametag, and combinations thereof.

* * * * *